United States Patent [19]

Norman et al.

[11] Patent Number: 4,586,850

[45] Date of Patent: May 6, 1986

[54] UNDERWATER TRENCHING SYSTEM

[76] Inventors: Robert M. Norman, 128 Nickerson Pkwy., Lafayette, La. 70501; Franklin C. Wade, 741 Bocage La., Mandeville, La. 70448

[21] Appl. No.: 513,095

[22] Filed: Jul. 12, 1983

[51] Int. Cl.[4] ..... E02F 5/02

[52] U.S. Cl. ..... 405/163; 405/160; 405/162; 114/52; 226/181; 226/190; 37/63

[58] Field of Search ..... 405/163, 164, 158, 161; 299/3, 9, 17; 37/63, 75, 78; 175/422; 474/8–11; 226/181, 190; 114/53, 54

[56] References Cited

U.S. PATENT DOCUMENTS

| | | | |
|---|---|---|---|
| 245,769 | 8/1881 | Blackwell | 474/9 |
| 737,021 | 8/1903 | Roberts | 405/164 |
| 2,852,868 | 9/1958 | Talbott et al. | 37/78 |
| 2,956,354 | 10/1960 | Varner | 37/63 |
| 3,004,392 | 10/1961 | Symmank | 405/163 |
| 3,326,607 | 6/1967 | Book | 175/422 X |
| 3,368,358 | 2/1968 | Elliott | 405/163 |
| 3,590,589 | 7/1971 | Smulders | 405/161 |
| 3,621,802 | 11/1971 | McGinn | 114/52 X |
| 3,782,317 | 1/1974 | Kriedt et al. | 114/52 |
| 3,877,237 | 4/1975 | Norman | 405/163 X |
| 3,978,679 | 9/1976 | LeComte | 37/63 X |
| 3,979,963 | 9/1976 | Goettl | 474/8 |
| 4,022,028 | 5/1977 | Martin | 37/63 X |
| 4,274,760 | 6/1981 | Norman | 405/163 |
| 4,295,757 | 10/1981 | Gaspar | 405/164 X |
| 4,389,139 | 6/1983 | Norman | 405/163 |

*Primary Examiner*—Dennis L. Taylor

*Attorney, Agent, or Firm*—Francis A. Keegan

[57] ABSTRACT

An underwater trenching apparatus for burying pipeline and the like including a frame for positioning about the pipeline to be buried, a drive roller system operatively connected to the frame for driving the frame along the pipeline and including at least one pair of opposed rollers, each of the rollers having a curved pipe contact surface having a radius less than the radius of the pipeline to be buried and configured to grasp about 40 percent of the circumference of the pipe, the arms to which the rollers are mounted pivot about a shaft which is removably mounted to the frame, and a cutting system attached to the frame for cutting a trench, the cutting system includes at least one pair of rotating discs rotating about a horizontal axis, and having water nozzles extending out from them, the water forced out of the nozzles scoops the seabed and disperses it up, away from the bottom of the trench. The pair of discs are mounted so that they can be moved up and down as well as rotated in and out. An eductor system for drawing up portions of cuttings cut by said cutting means in the trench and discharging these portions away from the trench can be mounted on a carriage separate from the frame which is pulled a distance behind the frame.

98 Claims, 26 Drawing Figures

UNDERWATER TRENCHING SYSTEM

FIELD OF THE INVENTION

This invention relates generally to a self-propelled underwater trenching apparatus. More particularly the present invention is concerned with the self-propelled buoyant apparatus for burying pipelines in a trench formed in the bottom of a body of water. The present invention further relates to the drive roller system, the trench cutting means, the buoyancy system, and the educting means for such an underwater trenching apparatus.

BACKGROUND OF THE INVENTION

Apparatus for burying pipeline, cable and the like have been well known in the art for many years. Essentially, they incorporate some means of jetting water in advance of the movement of the apparatus to dig and cut away a trench into which the pipeline is to rest. They further include a means for guiding and driving the apparatus along the pipeline to be buried, a buoyancy tank system which lifts the apparatus up so that its entire weight is not resting on the pipeline, and an eductor system for sucking up the cuttings and the other debris formed in the trench by the cutting means and discharging them away from the trench. Examples of such prior systems include U.S. Pat. Nos. 3,926,003, 3,877,237, 4,087,981 and 4,389,139. However, it has been found to be desirable to improve the efficiency of these prior art machines and to rectify some of the problems as will be discussed.

In particular, it has been found to be desirable to improve the traction exerted by the drive rollers on the pipeline and thereby to increase the speed that the apparatus moves down the pipeline for a given amount of input energy. Drive rollers in the past were typically V-shaped or hour-glass-shaped in which there was only a minimum contact interface between the pipe and the individual roller. These prior roller designs also provided for a generally flat or flat curved surface which was not in continuous contact with the pipe as it moved along the pipe.

One design for the cutting means provided for a downwardly depending pair of jet tubes each jet tube having a plurality of jets on its forward and side surfaces. Each of these jets, however, individually was unable to focus a large force of water against the sea bed. Also, inasmuch as the jets were not symmetrically disposed about the entire jet tube an undesirable backward reactive force was exerted. This force created a force on the jet tube as well as a backward force reacting against the driving motion of the drive rollers requiring greater traction. The jets further would cut the trench but would not effectively disperse the cuttings up and away from the trench to thereby aid the eductors in removing the cuttings from the trench.

The drive roller assemblies constituted an integral part of the frame in past designs. The mounting for the roller and the motor was secured to a vertical shaft that was welded into the frame in place. Therefor, when it was desired to replace a roller which had become damaged or worn, each damaged or ineffective unit would have to be removed sometimes taking many hours to replace the roller or the motor, etc.

Buoyancy systems for underwater trenching apparatuses have comprised a pair of buoyancy tanks rigidly mounted on opposite sides of the frame. Each of the tanks would include two or more noncommunicating vertical compartments disposed side by side. When it was desired to effect a torque on the frame to compensate for the torque exerted by underwater cross current, it was necessary to pump air into or out of one or more of the compartments on one or both sides of the apparatus. This was a complicated procedure and had the undesirable effect in that the overall buoyancy effect of the buoyancy tanks would be altered when it was desired to alter the torque effect that the buoyancy tanks exerted on the frame. Also, complicated pumping and valve mechanisms were required for each compartment in order to adjust the buoyancy effect of that compartment.

Eductors found in the prior art machines had been ineffective in excavating the ditch because of the turbulence of the water containing the cuttings surrounding the machine. The eductors were not efficient in that the cuttings do not settle until the machine has well passed beyond the initial point of cutting and they cannot be thoroughly discharged until they settle toward the bottom of the trench.

It is frequently desirable to have the machine make several passes along the pipe in order to dig a trench of the proper depth. In the past, typically it was a complicated procedure to either turn the machines around on the pipe or to cause a reversal of the motions of the individual components.

OBJECTS OF THE INVENTION

Accordingly, it is the principal object of the present invention to provide a novel and improved underwater trenching apparatus.

Another object of the present invention is to provide a novel drive roller assembly with improved driving traction for an underwater trenching apparatus.

A further object of the present invention is to provide a novel drive roller design which effectively grips the pipe.

A still further object of the present invention is to provide an improved drive roller assembly having roller contact with a greater proportion of the circumference of the pipe.

Another object is to provide an improved drive roller assembly which is less likely to crack the pipe coating.

A further object is to provide a novel means for mounting the hydraulic rams which urge the roller arms against the pipe.

A still further object is to provide a novel design for mounting the roller assembly so that it can be easily removed when damaged or worn and subsequently replaced.

Another object is to provide a novel fluid jet cutting means for an underwater trenching apparatus which rotates about a horizontal axis generally transverse to the pipeline thereby eliminating undesired back pressure and force vectors, and novel means for raising and lowering the cutting means.

A further object is to provide a novel high velocity fluid cutting means which utilizes a scooping action to cut a trench.

A still further object is to provide a novel cutting means which disperses the cuttings up and away from the trench.

Another object is to provide a novel means allowing for a greater concentration of the cutting energy and cutting forces.

A further object is to provide an improved high velocity fluid cutting means using larger diameter orifices so that a greater mass of water can be forced out.

A still further object is to provide a cutting means which includes a sawing means for severing cables, and other objects which can be caught in the cutting means.

Another object is to provide a novel frame design which allows the cutting means to be positioned within the side surfaces of the frame but adjustable in a vertical direction so that they can be lifted so that they are generally adjacent the bottom surface of the pipe.

A further object is to provide a novel frame design which allows the driving means to be reversed so that the frame travels the opposite direction along the pipe cutting the bottom formation deeper as it travels.

A still further object is to provide a novel means for opening the jet tubes wide enough to admit the pipe therebetween.

Another object is to provide a novel means for rotating the jet tubes which does not use hydraulic rams which are subject to leaks.

A further object is to provide a novel means for exerting a torque on the underwater trenching apparatus to compensate for the torque exerted on the apparatus by underwater currents so that the apparatus can be maintained in a constant upright position.

A still further object is to provide a torque exerting system which does not require that the buoyancy effect of the individual buoyancy tanks be altered when changing the torque.

Another object is to provide a novel positioning means for the buoyancy tanks to provide a torque on the frame, such positioning means allowing the buoyancy tanks to be adjusted to accommodate currents exerting a force in any direction on the frame and also allowing the tanks to always be held in an upright position.

A further object is to provide a novel buoyancy tank design which provides for the easy adjustment of the air level in the tank and thus the buoyancy effect of that tank.

A still further object is to provide a novel eductor system for an underwater trenching apparatus which more thoroughly draws up portions of the cuttings cut by the cutting means of the apparatus and discharges these portions from the trench, and which also removes the settled silt from the trench.

Another object is to provide a novel eductor system which is spaced a distance from the cutters so that the cut material has a time to settle and can then be more efficiently discharged from the trench.

A further object is to provide a novel eductor system which utilizes an eductor carriage positioned behind and pulled by the main frame of the underwater trenching apparatus.

A still further object is to provide a novel eductor carriage having its own buoyancy and guide roller systems.

Another object is to provide a novel guide system for an eductor carriage in which the bottom guide roller can be readily swung out of the way so that the eductor carriage can be removed up from and positioned down on the pipeline and then subsequently moved into position below the pipeline for guiding the carriage along the pipeline.

Other objects and advantages of the present invention will become more apparent to those persons having ordinary skill in the art from the following description taken in conjunction with the accompanying drawings.

THE DRAWINGS

DESCRIPTION OF THE INVENTION

Figure 1:
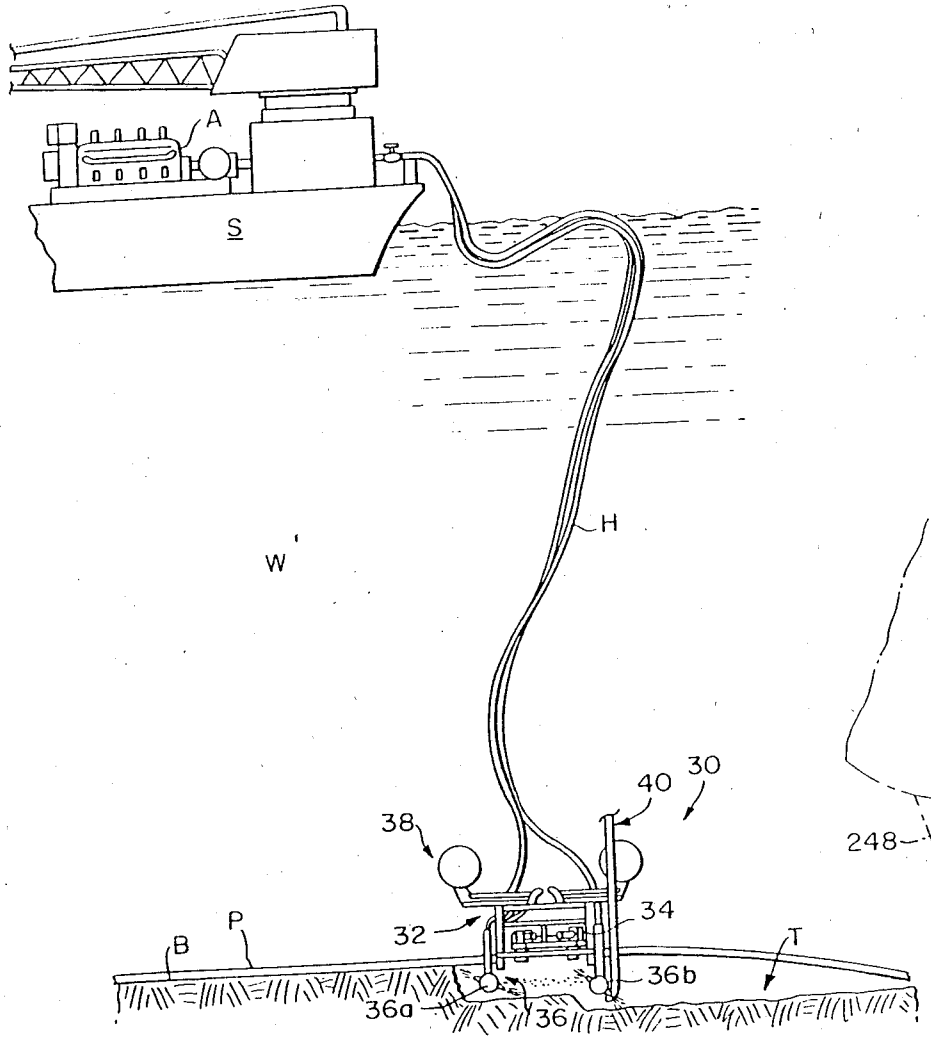
FIG. 1 is a side-elevational view of an underwater trenching apparatus embodying the present invention shown in its underwater working environment.

Referring to FIG. 1, there is illustrated an apparatus shown generally at 30 constituting the present invention. The apparatus is guided along pipe P to be buried in the trench T formed by the apparatus. Apparatus 30 proceeds to the left in FIG. 1 on the pipeline P that has been previously laid on the bottom B of the body of water W. Connected to apparatus 30 by means of various air and water hoses H is the pumping apparatus A positioned on barge or ship S.

Apparatus 30 is seen principally to comprise a frame shown generally at 32 positionable over pipeline P, a drive roller assembly 34 mounted within frame 32 for driving frame 32 along pipeline P, a cutting assembly 36 which is shown in FIG. 1 to comprise a forward fluid jet cutting assembly 36*a* and an aft fluid jet cutting assembly 36*b*. Cutting assembly 36 is mounted to frame 32 and cuts a trench T in bottom B as frame 32 is driven along pipe P by drive roller assembly 34. Buoyancy tanks shown generally at 38 are attached to frame 32 and not only lift the apparatus 30 off of pipe P so that its entire weight does not bear against pipe P and thus so it can be driven more easily along the pipe but it also provides a torque compensating means for compensating for the torque exerted on apparatus 30 by underwater cross currents, as will be more fully described later. An eductor system shown generally at 40 is secured to an aft portion of frame 32 and is provided with a suction means at its lower end to suck cuttings cut by the cutting assembly 36 at the trench and to discharge them at its upper end away from trench T thereby forming a deeper trench. Although eductor system 40 is shown in FIG. 1 to be attached to frame 32, it is also within the scope of the present invention to provide an eductor carriage shown generally at 42 in FIGS. 20 through 22 which is spaced behind and pulled by frame 32 and to which eductor system 40 is mounted. This also will be more fully described later.

Figure 3:
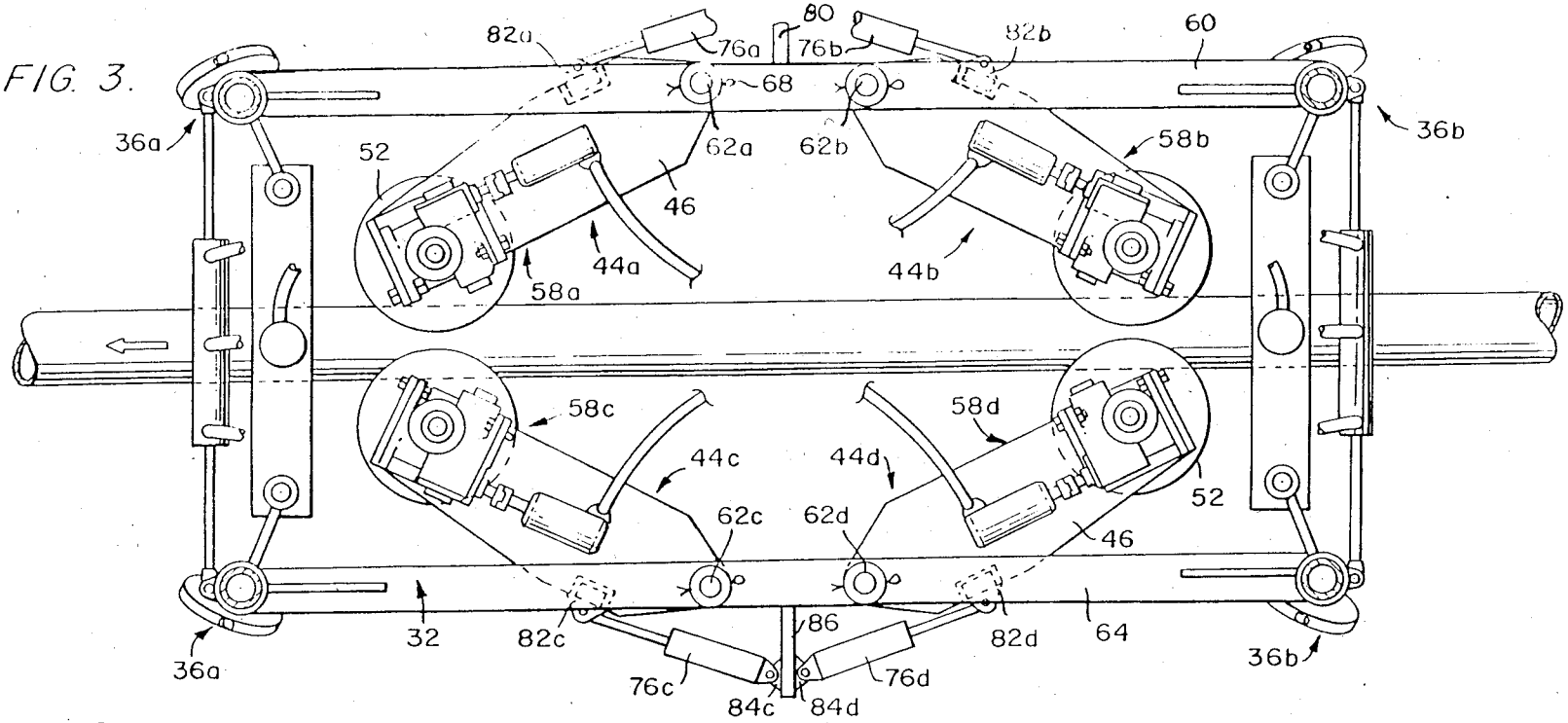
FIG. 3 is a cross-sectional view taken along line 3—3 of FIG. 2.
Figure 19:
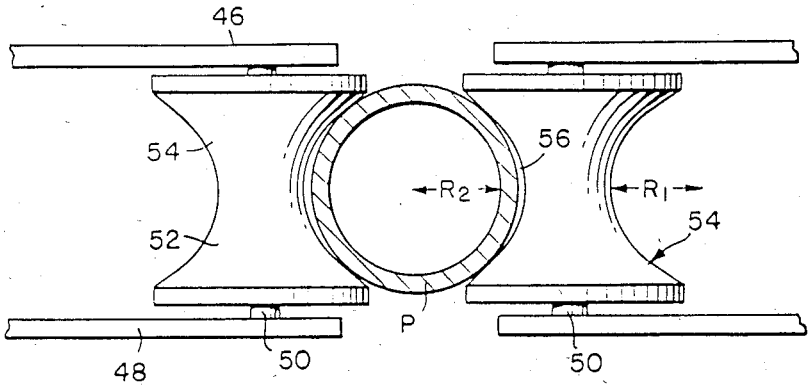
FIG. 19 is an enlarged cross-sectional view illustrating the rollers of the apparatus of FIG. 17 prior to engaging the pipe.
Figure 17:
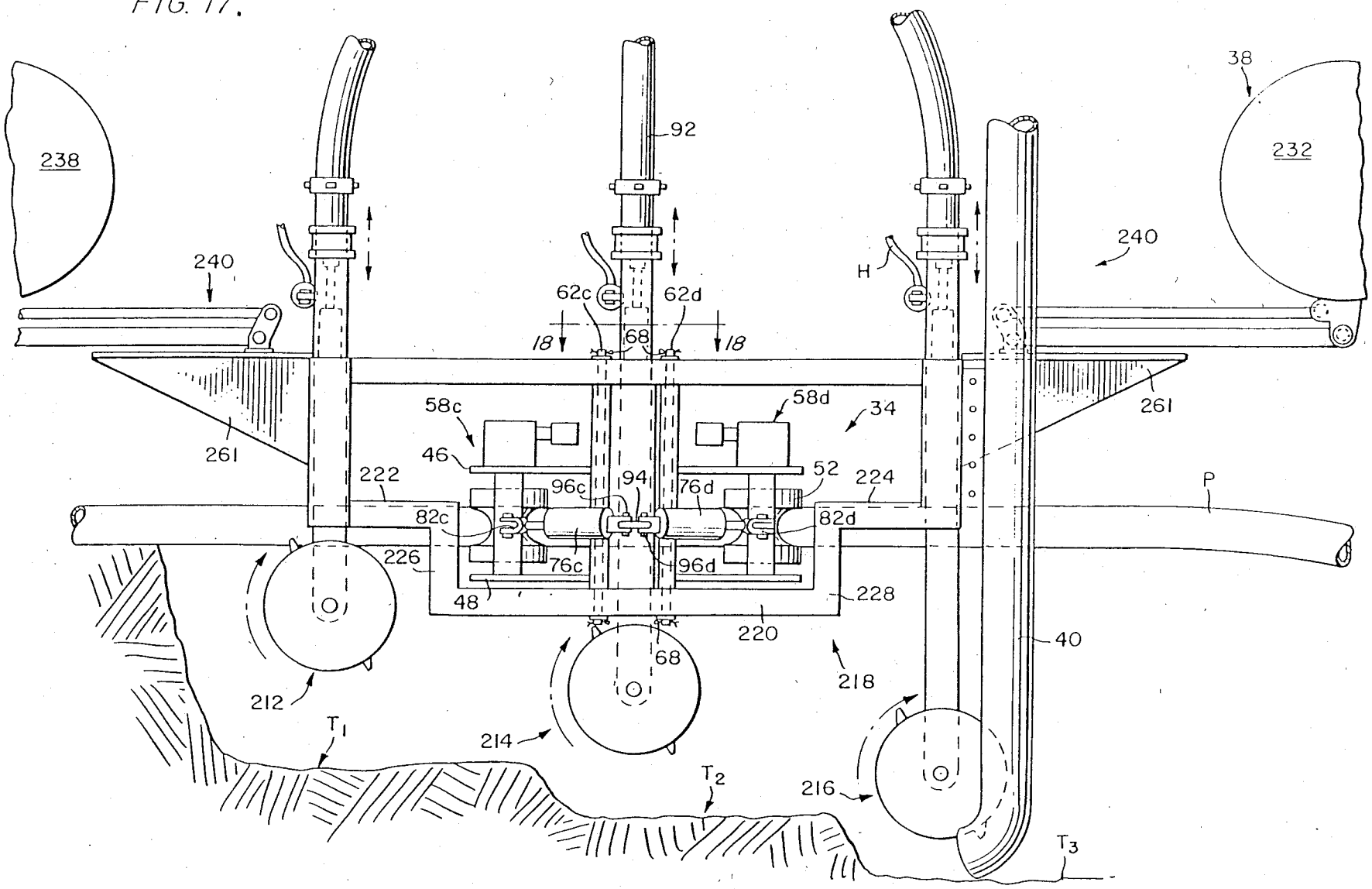
FIG. 17 is an enlarged side-elevational view similar to FIG. 2 illustrating another second embodiment of the present invention pairs of rotating jets.

Referring to FIGS. 3, 17 and 19, the drive roller assembly 34 is illustrated in greater detail. It is seen to comprise four identical roller arm assemblies shown generally at 44*a*, 44*b*, 44*c* and 44*d*. Each roller arm assembly 44 includes a pair of parallel generally horizontally disposed arms 46 and 48. As best shown in FIG. 19, roller 52 is rotatably mounted by shaft 50 between arms 46 and 48 at the inboard end of the arms adjacent the pipeline. It is seen in FIGS. 19 and 3 that rollers of opposing roller arm assemblies, for example 44*a* and 44*c*, are positioned to engage opposite sides of pipeline P. The rollers 52 as taught by the present invention embody a novel design wherein each roller 52 has a generally vertically-positioned symmetrical convex shape. Roller 52 has a curved contact surface 54 positioned to engage pipe P. Curved surface 54 has a generally circular convex curvature having a radius $R_1$ which is shorter than radius $R_2$ of pipe P. Thus, when rollers 52 are positioned so that they initially touch pipe P, a space 56 is formed between the outer surface of pipe P and surface 54. However, the rollers 52 are formed of a hard rubber material having approximately a 90 durometer consistency. When rollers 52 are forced against pipe P, as will be more fully described later, contact surface 54 is forceably deformed to be in continuous contact with the outer surface of the pipeline thereby providing a better gripping and traction effect. It is further seen that the convex contact surface 54 on each roller is configured to grip about 40 percent of the circumference of the pipe P when in forced driving contact. Thus, the opposing rollers will grip about 80 percent of the circumference of pipe P. It is preferred that the roller contact surface 54 grasps at least 30 percent of the pipe but no more than 40 percent initially since the hard rubber rollers 52 will eventually wear so that the roller contact surface 54 will contact greater than 40 percent of the pipe and it is not desirable that the rollers on either side engage each other at either their top and bottom edges.

Figure 2:
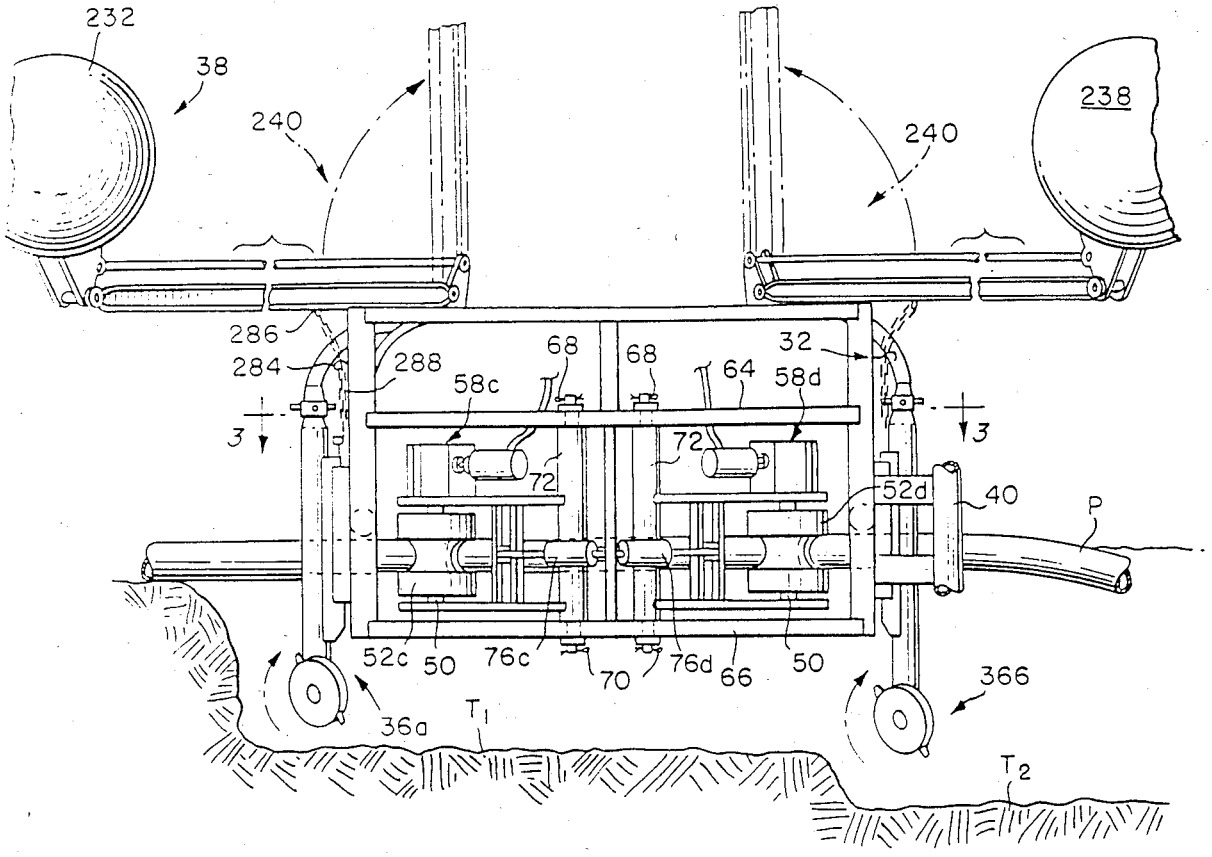
FIG. 2 is an enlarged, partially broken away view of the apparatus of FIG. 1 illustrating the movement of the buoyancy tanks in phantom lines.

Hydraulic motors with suitable gearing, both shown generally at 58*a*, 58*b*, 58*c*, and 58*d*, are each mounted on the top of arms 46*a*, 46*b*, 46*c*, and 46*d*, respectively. Each motor is connected to respective shafts to rotate the shafts and thereby rotate its roller. Each arm is connected to a longitudinal member of frame 32. As seen in FIG. 3, arms 44*a* and 44*b* are connected to member 60 of frame 32 by connections 62*a* and 62*b* respectively. Similarly, arms 44*c* and 44*d* are connected to longitudinal member 64 of frame 32 by connections 62*c* and 62*d* respectively. Referring to FIG. 2, it is seen that connections 62*c* and 62*d* each comprise a shaft passing through member 64 at its upper end and 66 at its lower end and removably secured at its upper and lower ends by cotter pins 68 and 70. Rotatably disposed about the shafts are collars 72 which extend between members 64 and 66 and to which the arms are rigidly secured. Thus, as the arms are rotated about the shaft the collar rotates about the shaft. This design is a vast improvement over the prior roller mounting assembly in that each roller arm can be easily removed and repaired or replaced. Previously, the arms were not removable and the entire apparatus would have to be removed from the pipe and repaired if one of the rollers needed repair.

Each of the roller arm assemblies 44 are forced against the pipe P by hydraulic rams 76*a*, 76*b*, 76*c* and 76*d*, respectively. Ram 76*a* is secured at one end to a pad eye (not shown) mounted on a stiff back 80 and at its opposite piston rod end to an ear 82*a* secured to a side of arm 44*a*. Hydraulic ram 76*b* is likewise connected to a pad eye (not shown) on the opposite side of stiff back 80 which is mounted perpendicular to member 60 and is pivotally attached at its piston rod end to ear 82*b* attached to arm 44*b*. Hydraulic ram 76*c* is likewise connected to pad eye 84*c* which is mounted to stiff back 86 which is mounted perpendicular to member 64. Hydraulic ram 76*c* is pivotally attached at its piston rod and to ear 88 which is mounted to the outside of arm 44*c*. Similarly, hydraulic ram 76*d* is pivotally connected at one end to pad eye 84*d* on stiff back 86 and at its opposite piston rod end to ear 82*d* attached to the outside of arm 44*d*. Thus, as each of the piston rods of each of the hydraulic rams 76 is extended, each arm 44 pivots about connection 62 towards pipe P forcing rollers 52 into driving and gripping contact with the pipe. When the piston rods of hydraulic rams 76 are retracted the arms are swung out away from pipe P and the frame can be positioned up and off of pipe P.

Figure 18:
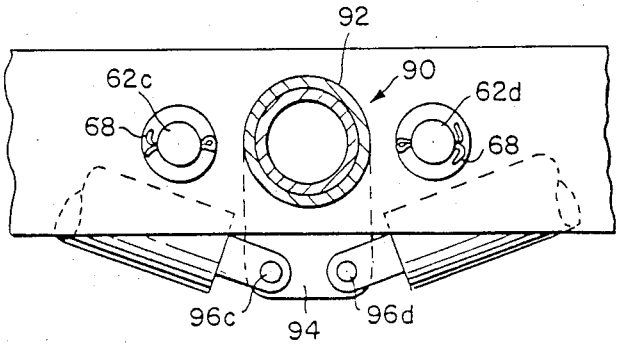
FIG. 18 is a cross-sectional view taken along line 18—18 of FIG. 17.

In lieu of stiff backs 80 and 86 another mounting arrangement for the outside ends of the hydraulic rams is shown generally at 90 in FIG. 18. This embodiment can be used when the middle jet tube 92 is used, as in the embodiment illustrated in FIG. 17 which will be described more fully later. In this variation, the connections 62*c* and 62*d* including cotter pins 68 and 68 are generally the same as previously described but the stiff back 86 has been replaced by a plate 94 disposed about a jet tube 92. Pivotal connections 96*c* and 96*d* are provided through opposite openings at the outer end of plate 94.

A pressure gauge (not shown) is provided aboard the ship for each of the hydraulic lines feeding to each of the hydraulic rams to measure the pressure in each of the lines. Typically, when the rams are fully extended forcing the rollers into driving and gripping contact with the pipe, a pressure of 1200 to 1800 pounds is in each of the lines. This pressure rises considerably when the rollers encounter an anode, irregularity or obstruction on the pipeline. Personnel aboard the ship monitor the pressure gauges and when there is an increase of pressure of several hundred pounds in the lines feeding the forward rams indicating that the forward rollers have reached an obstruction the following procedure is followed. (1) Pressure in the lines to the forward rams is reversed thereby positively opening the forward rams. (2) The pressure in the lines to the rear rollers propells the apparatus along the pipeline and the forward rollers over the obstruction. (3) The forward rams are closed and both the forward and rear rollers propell the apparatus forwardly. (4) When the rear rollers reach the obstruction, the pressure to the rear rams is reversed thereby retracting the rear rams and moving the rear rollers away from the pipeline. (5) The forward rollers held against the pipeline propell the apparatus along the pipeline. (6) Once the rear rollers have cleared the obstruction, hydraulic pressure is returned to the rear rams to provide traction from the rear rollers and the apparatus continues cutting trench and moving down the pipeline.

Figure 11:
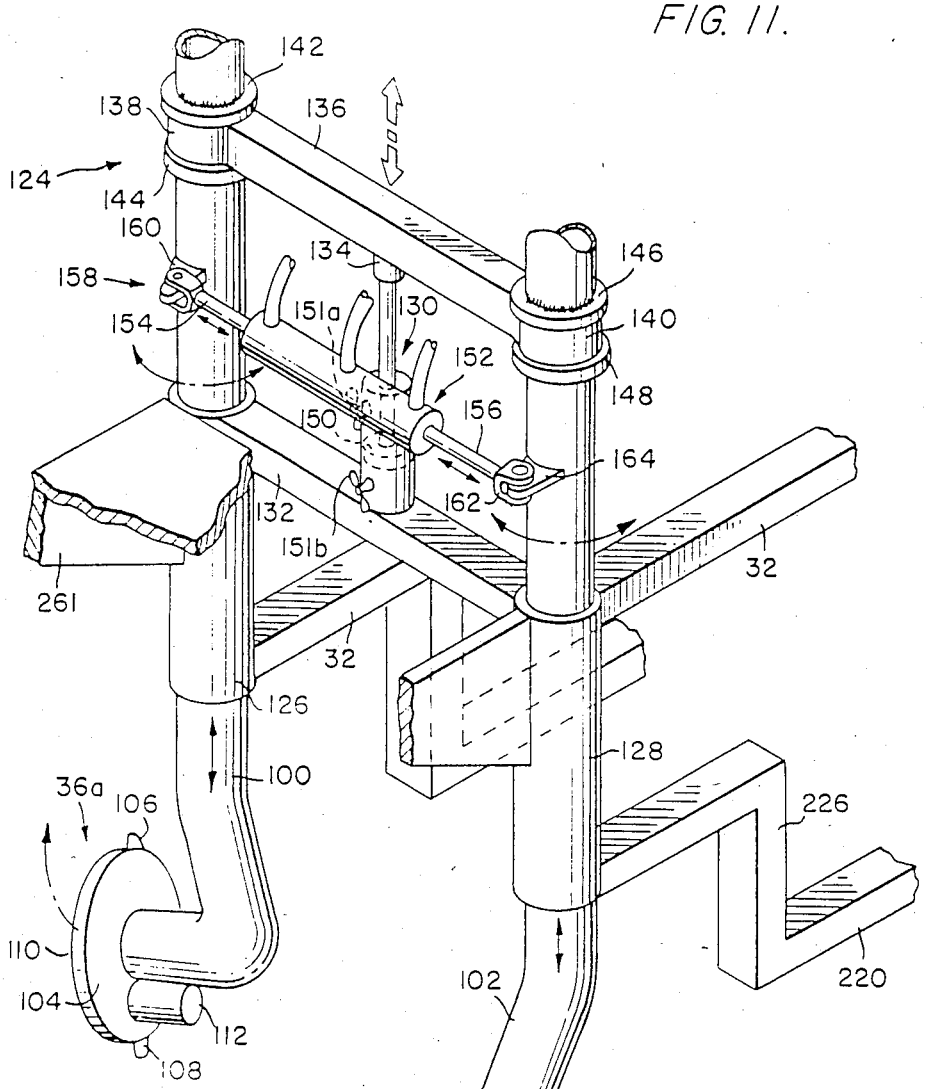
FIG. 11 is an enlarged perspective, partially broken away view of the jet tube mounting assembly of FIG. 4, illustrating the movement thereof.

The present invention further provides for a novel trench cutting assembiy 36*a* mounted at a forward location of frame 32 and a similar cutting assembly 36*b* mounted at the aft portion of the frame 32. Cutting assembly 36*a* is best illustrated in FIG. 11 and it is seen that it comprises two fluid jet tubes 100 and 102. A rotatable disc 104 having jet nozzles 106 and 108 extending out of it is attached at the lower end of tube 100 and is rotatable about axis 110 by motor 112. A similar arrangement with disc 114, nozzles 116 and 118 rotatable about axis 120 by motor 122 is provided for jet tube 102.

The present invention also provides for a novel mounting arrangement shown generally at 124 in FIG. 11 for jet tubes 100 and 102. Mounting arrangement 124 allows jet tubes 100 and 102 to be moved vertically together and also to be moved, independent of the vertical movement, in opposite but equal rotational directions. Jet tube 100 is slidably received in sleeve 126 secured to frame 32 and jet tube 102 is slidably received in sleeve 128 which is likewise attached to frame 32. Grease ram 130 is mounted at its lower end to cross bar 132 which is mounted to sleeve 126 and 128 and does not move in a vertical manner. The upper end of grease ram 130 is attached at 132 to the underneath surface of dog bone 136. Dog bone 136 has collars 138 and 140 at opposite ends. Jet tube 100 is positioned to rotate within collar 138 and jet tube 102 is positioned to rotate within collar 140. Positioned above collar 138 is ring 142 which is not attached to collar 138 but is welded to tube 100 and a similar ring 144 is welded beneath collar 138 to tube 100. Corresponding ring 146 and ring 148 are welded to tube 102 above and below collar 140. Thus, as piston 150 of grease ram 130 is extended, dog bone 136 is pushed up and against rings 142 and 146 thereby lifting jet tubes 100 and 102 in a vertical manner; likewise, when piston 150 is retracted dog bone 136 pulls rings 144 and 148 and lowers the jet tubes. The operation of the grease ram 130 to grease and lower the assembly 36*a* is with a grease gun (not shown) that uses a semi-solid grease forced in under pressure of the gun into either one of the grease "T"s 151*a* and 151*b* which have a valved opening so that as the grease is forced in T 151*a* to move piston 150 downwardly the T 151*b* must be opened to allow the grease to be released into the water. The amount of grease lost is so small as not to cause any environmental concern. To move the piston upwardly the reverse process takes place.

A double acting hydraulic ram of conventional function is provided at 152. Ram 152 has piston rod 154 extending from one end and piston rod 156 extending from the other end. A pivotal connection between rod 154 and ear 158 mounted on jet tube 100 is provided at one end and a pivotal connection 162 is provided at the outer end of rod 156 and is connected to ear 164 mounted on jet tube 102. Thus, it is seen that when the rods 154 and 156 are extended together the jet tubes 100 and 102 rotate in opposite outward manners, and when rods 154 and 156 contract together jet tubes 100 and 102 rotate in opposite inward manners. As previously mentioned, jet tubes 100 and 102 rotate freely in collars 138 and 140.

Figure 12:
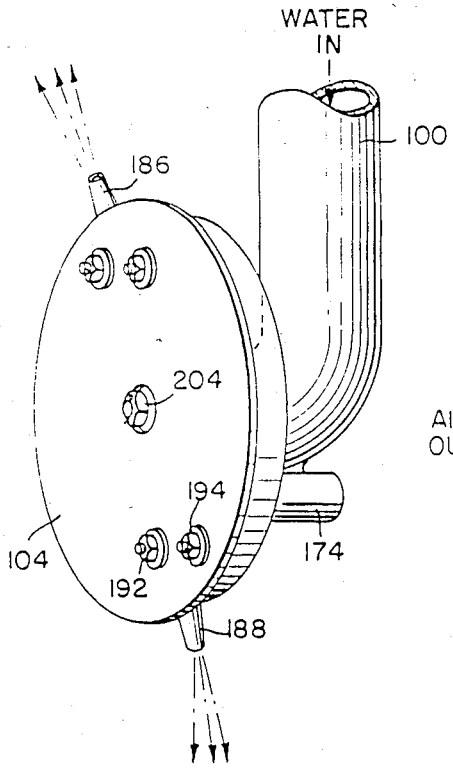
FIG. 12 is an enlarged perspective view of the rotating jets of FIG. 11.

FIG. 12 illustrates one embodiment of the present invention utilizing a plain outer disc 104 for the jet nozzles, the disc providing a shield as well as a mounting system for the nozzles. A second embodiment of the present invention is illustrated in FIGS. 13 through 16 wherein a cutter disc 170 is used having teeth 172 outwardly projecting from the outer perimeter and when rotating providing a sawing means for snapping cables, limbs, etc. which may snag the jet nozzle.

Figure 14:
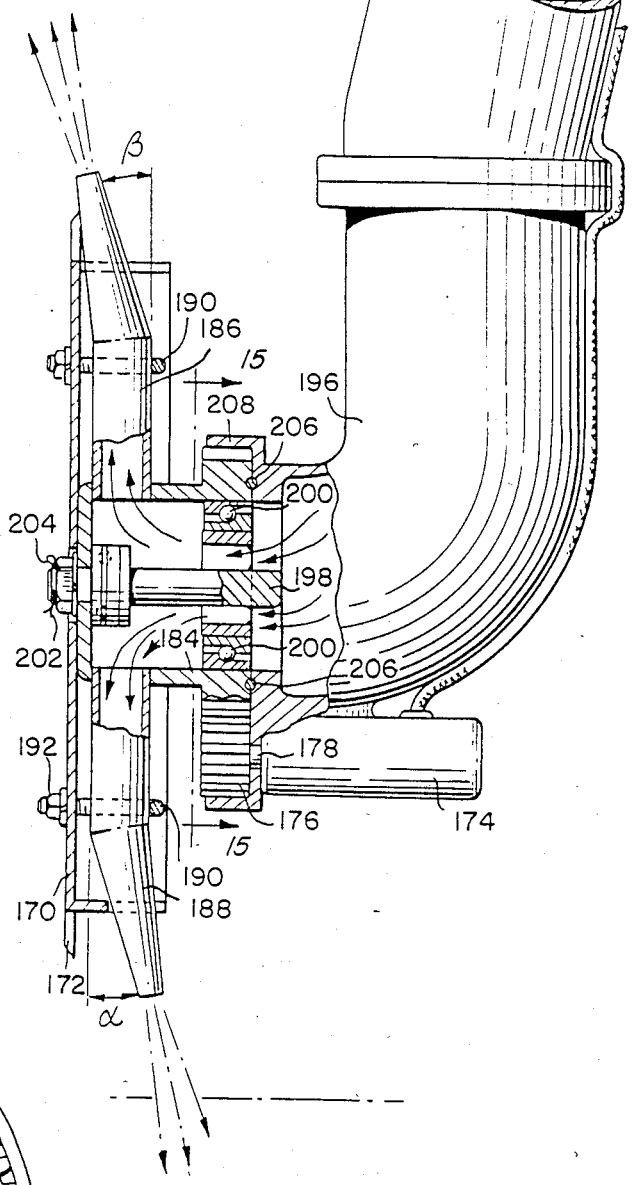
FIG. 14 is a cross-sectional view taken along line 14—14 of FIG. 13.
Figure 15:
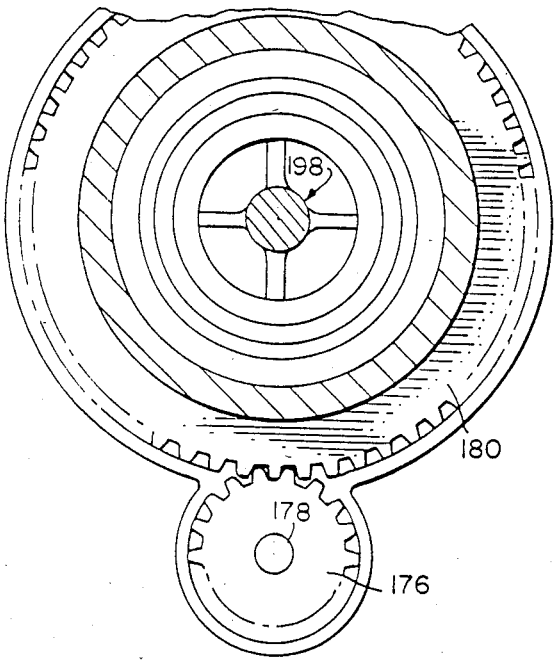
FIG. 15 is a cross-sectional view taken along line 15—15 of FIG. 14.
Figure 16:
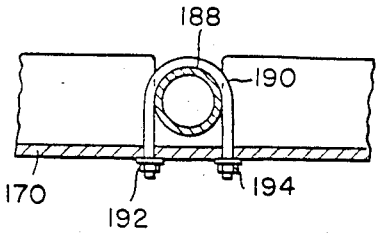
FIG. 16 is a cross-sectional view taken along line 16—16 of FIG. 13.

Referring to FIG. 14, it is seen that motor 174 rotates spur gear 176 at the end of its output shaft 178. Spur gear 176 engages gear 180, as shown in FIG. 15, which is mounted to the housing 184 to which jet nozzles 186 and 188 are attached. Disc 170 is secured to nozzles 186 and 188 by a U-shaped bracket 190, as best shown in FIG. 16, which has nuts 192 and 194 which tighten bracket 190 against disc 170. Disc 170 and nozzle housing 184 are held axially against the lower end of jet tube 196 by a rod and spider arrangement shown at 198 in FIGS. 14 and 15. Gear 180 rotates about rod and spider arrangement 198 via ball bearings 200. Rod 198 is secured to disc 170 by a suitable nut arrangement 202 and at the other end to the jet tube. A cotter pin 204 is provided so that the disc 170 can be easily removed from rod 198. Suitable 0-ring seals 206 are positioned between the housing 184 and the jet tube mounting collar 208 to provide a watertight seal. Motor 174 will rotate the nozzles between 1 to 10 revolutions per minute and 20 and 30 revolutions per minute.

As best shown in FIG. 14, nozzle 188 is offset from the plane of rotation by an angle alpha and nozzle 186 is offset from the plane of rotation by an equal and opposite angle beta. Angles alpha and beta are between 5° and 20°. It is within the scope of the present invention to provide at least 2 nozzles and up to 8 or more nozzles. The nozzles should be symmetrically positioned about the axis of rotation so that no unbalancing forces are produced. They should also be offset from the plane of rotation in equal and opposite manners. The offsetting of the nozzles from the plane of rotation provides for a wider impact area of the water forced out of the nozzles and thereby providing a wider scooping action. Each of the nozzles is about ½" and exerts a water pressure of 650 to 675 psi.

Another and perhaps more significant advantage of this novel nozzle arrangement is that there is essentially no rearwardly directed force, as is common with prior art jet nozzles, because of the vertical plane of rotation and the symmetry of the nozzle arrangement. Thus, the traction required by the drive rollers is considerably reduced.

The jet discs in FIG. 11 are shown to be slanted downwardly and inwardly forming through extension a downward V-shape. The disc 104 and 114 also toed in so that a narrow trench may be dug that is merely wide enough for the machine. It is expected that the forward jet disc would be slanted or offset from the vertical at an angle of about 30°, and the aft jet discs would be slanted or offset at a greater angle of about 35°. Referring to FIG. 2, it is seen also that the aft discs are positioned lower than the forward discs so that a level T1 of the trench may be dug to produce the proper level T1 of the trench.

Figure 9:
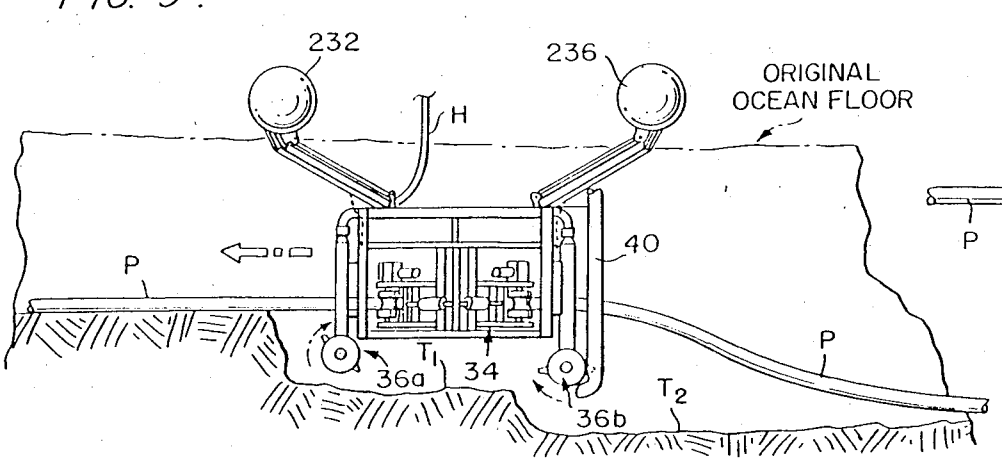
FIG. 9 is an enlarged side-elevational view of the underwater trenching apparatus of FIG. 1.

It is also within the scope of the present invention to provide for three sets of cutting assemblies shown in FIG. 17 at 212 to 214 and 216 each of which digs, respectively, trenches T1, T2 and finally T3. Mounting assemblies such as that previously discussed and illustrated at 124 can be provided for each of the cutting assemblies. Thus, when it is desired to reverse the direction of the frame, such as is illustrated in FIG. 9, to dig a deeper trench, the heights of the individual cutting assemblies can be adjusted so that the forwardmost assemblies are the highest and aft assemblies are positioned progressively lower. Still referring to FIG. 17, it is seen that a downward "jog" feature in the middle of frame is provided as shown generally at 218. Jog feature 218 includes lower longitudinal member 220 positioned beneath drive roller assembly 34 and forward and aft longitudinal members 222 and 224 connected to member 220 via vertical members 226 and 228 respectively. As can be seen cutting assemblies 212 and 216 may now be raised to a level adjacent the bottom portion of the pipe and slightly above the lower portion of the driver roller assembly.

Figure 7:
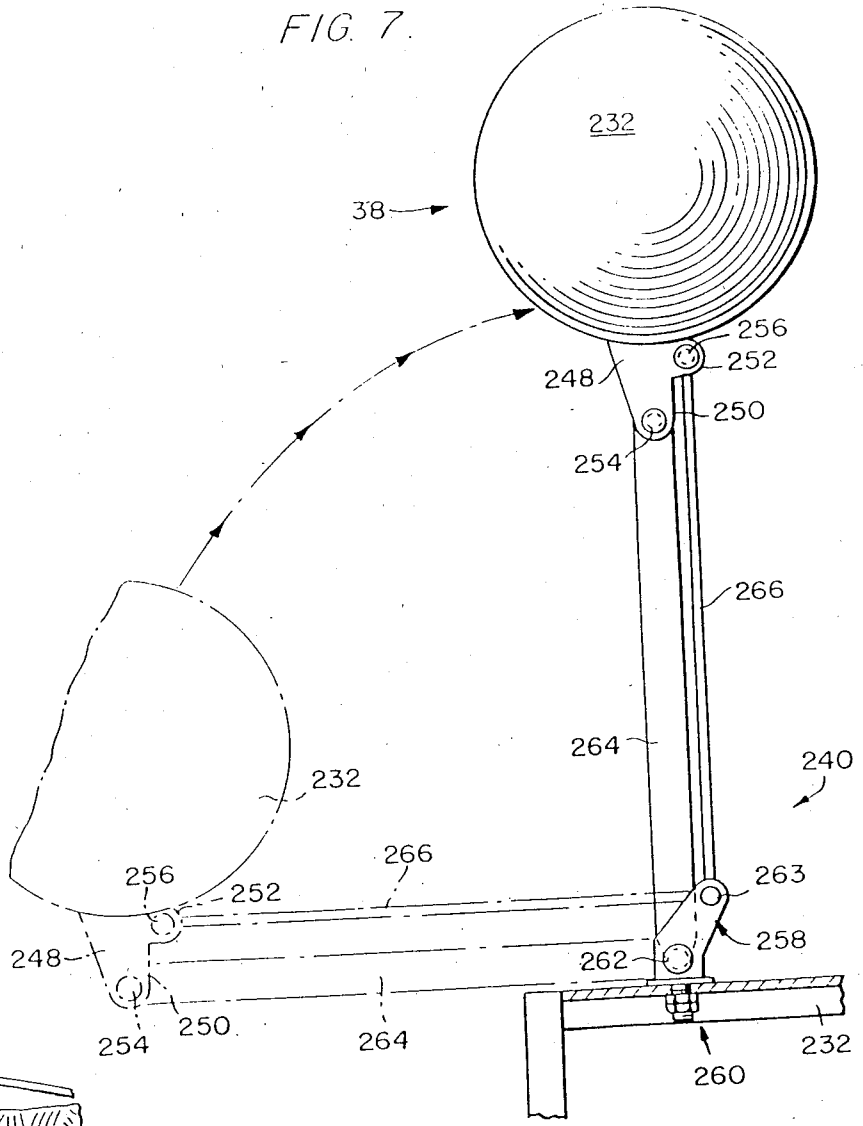
FIG. 7 is an enlarged side-elevational view of the adjustable buoyancy tank mounting means of FIG. 2 illustrating the movement thereof in phantom lines.
Figure 4:
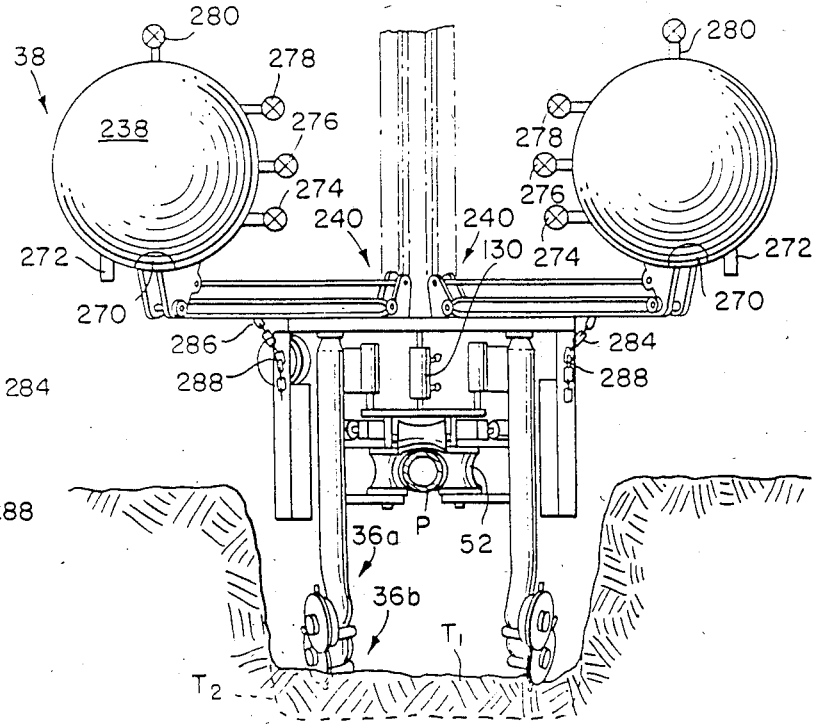
FIG. 4 is an end view of the apparatus of FIG. 2.
Figure 5:
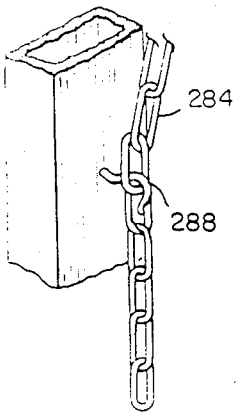
FIG. 5 is an enlarged perspective view partially broken away illustrating the chain locking means for the buoyancy tank of FIG. 4.
Figure 8:
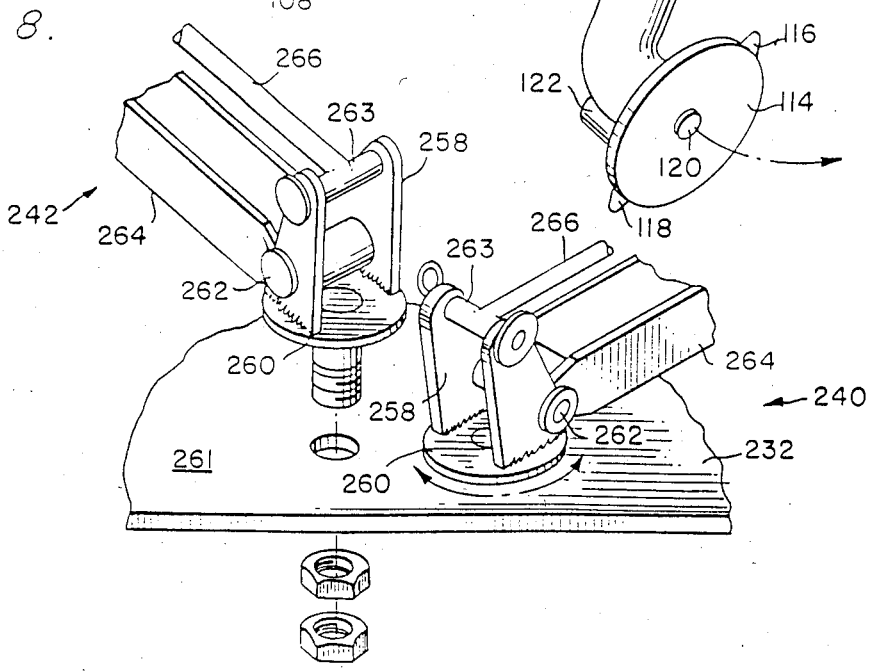
FIG. 8 is an enlarged, partially broken away perspective view of the mounting device of the buoyancy tank mounting means of FIG. 7.
Figure 13:
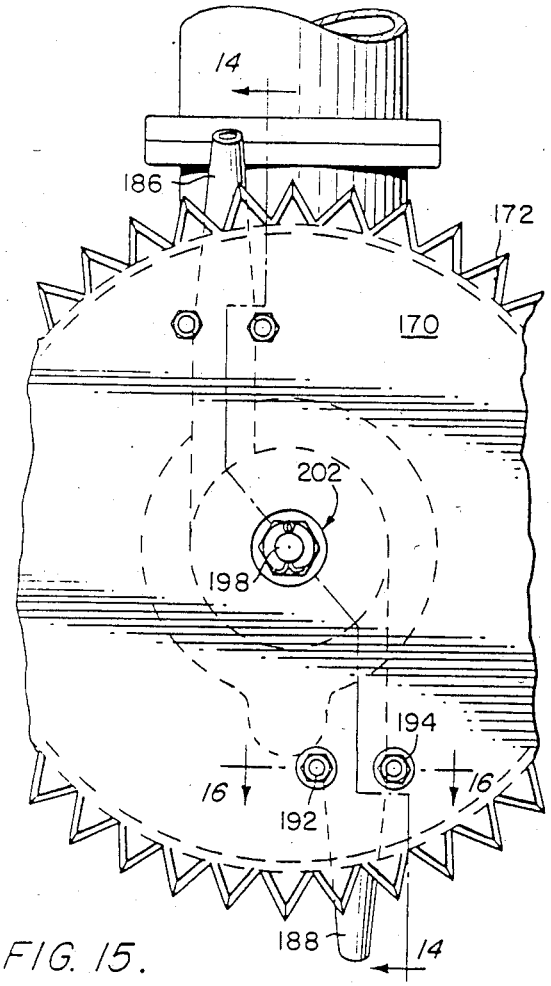
FIG. 13 is a front-elevational view of another embodiment of the rotating jets of FIG. 12 including a cutting disc.
Figure 21:
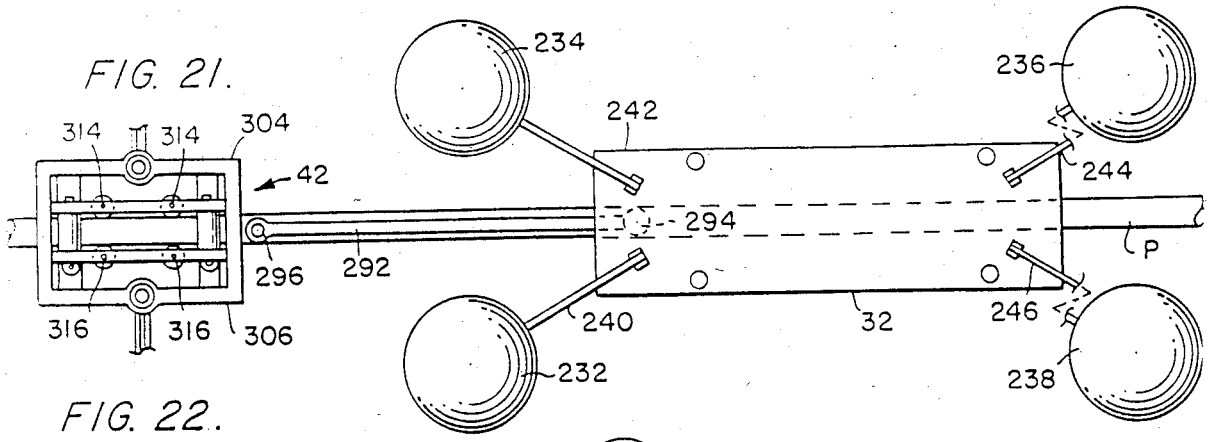
FIG. 21 is a top plan view of the apparatus of FIG. 20.
Figure 22:
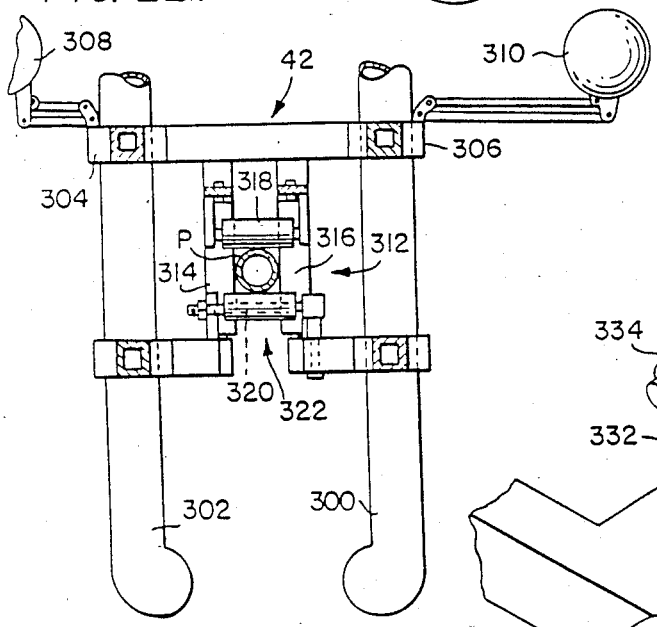
FIG. 22 is a cross-sectional view taken along line 22—22 of FIG. 20.

Buoyancy tank assembly 38 comprises, as shown in FIGS. 2, 4 and 21, four tanks 232, 234, 236, and 238. The tanks are generally identical and each includes a novel mounting arrangement shown at 240, 242, 244 and 246, respectively. The mounting arrangement to the tank is best shown in FIG. 7. Referring thereto, it is seen that mounting arrangement 240 comprises a pair of parallel plates 248 mounted to the bottom surface of tank 232. Plate 248 has ears 250 and 252. Shaft 254 is positioned in an opening in ear 250 and shaft 256 is disposed in an opening in ear 252. As best shown in FIG. 8, a similar pair of opposed parallel plates 258 is mounted on the head of pivot pin 260 which pivots in an opening in a horizontal surface of frame 32 or more particularly in gusset 261 extending from frame 32. A first shaft 262 is pivotally positioned between plates 258 and a second shaft 263 is pivotally positioned between the plates above and offset from first shaft 262. A first bar 264 is mounted at one end to shaft 254 and at the other end to shaft 262. Second bar member 266 is mounted at one end to shaft 256 and at the other end to shaft 263. Thus, as can be readily seen from FIGS. 7 and 8, buoyancy tank 232 may be raised and lowered but still maintained at all times in an upright position. Connection 260 also provides for a movement of plates 258 and thus tank 232 about a vertical axis.

Figure 10:
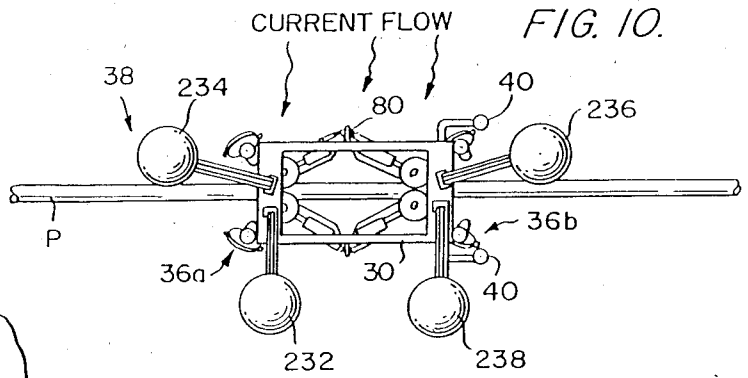
FIG. 10 is a top plan view of the apparatus of FIG. 9 illustrating the operation of the adjustable mounting means of the buoyancy tanks.

Thus, each tank can be moved to a new horizontal and vertical position relative to frame 32. Referring to FIG. 10, which is a top view of the apparatus 30, it is seen that the tanks may be positioned to produce a torque counter to the torque exerted on the apparatus by cross currents, thereby maintaining the apparatus in a generally constant upright position relative to pipeline P. The greater the horizontal distance the tank is to the pipeline the greater torque produced by the buoyancy effect of the tank because the moment arm is greater. Thus a greater torque is produced by tanks 232 and 238 as illustrated in FIG. 10 in a counter-clockwise manner when viewed from the forward portion of the apparatus than the clockwise torque produced by tanks 234 and 236. This net counter-clockwise torque compensates for the sidewardly current flow shown in FIG. 10.

Figure 6:
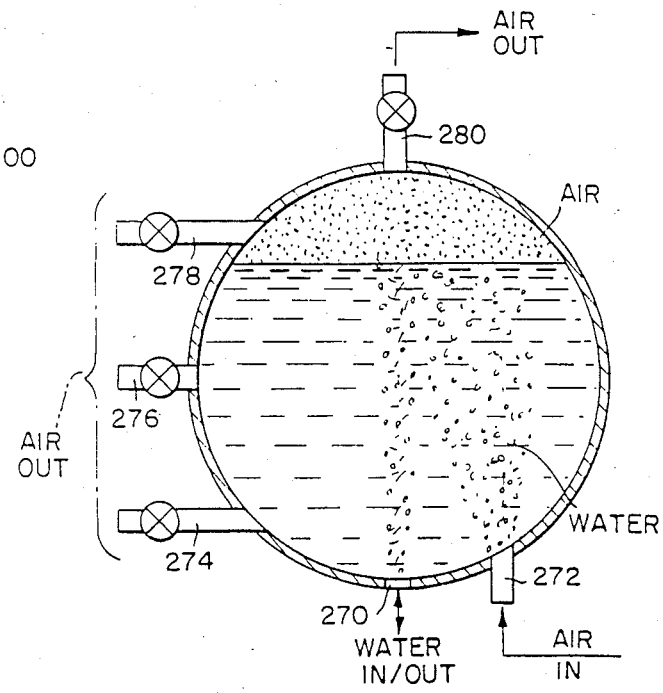
FIG. 6 is an enlarged cross-sectional view of a buoyancy tank of FIG. 4 illustrating the operation thereof.

It is further within the scope of the present invention to provide a novel, quick and easy means for adjusting the level of air and water, and thus the buoyancy effect, of each of the tanks. This is shown in FIG. 4 and in greater detail in FIG. 6. Referring thereto it is seen that the tank is provided on its lower surface with an open bottom at 270 freely communicating with the water W. An air pump inlet 272 is positioned along a bottom surface of the tank. A plurality of air outlet nozzles shown at 274, 276, 278 and 280 are provided at different horizontal planes of the tank. It is seen that nozzle 274 is above air pump inlet 272 and nozzle 280 is positioned along the upper surface of the tank. When it is desired to have a generally 100 percent buoyancy effect, nozzles 274, 276, 278 and 280 are closed and air is pumped in through pump inlet 272 until all the water has been forced out of outlet 270. If then for example only a quarter buoyancy effect is desired, such as is generally shown in FIG. 6, valves 274 and 276 are opened.

Further, mounting assembly 240 can be held in so that the buoyancy tank is in the desired vertical position by the adjustment of chain 284. Chain 284 which is secured at its upper end 286, as shown in FIG. 2, to first bar 264 and is secured at its other end at the desired length by hooking hook 288 in the desired link of the chain. Thus, assuming that the buoyancy tank has been adjusted to the desired buoyancy effect, as previously discussed, the buoyancy tank then holds the chain 284 taut and the tank is thereby held in its desired vertical position.

Figure 20:
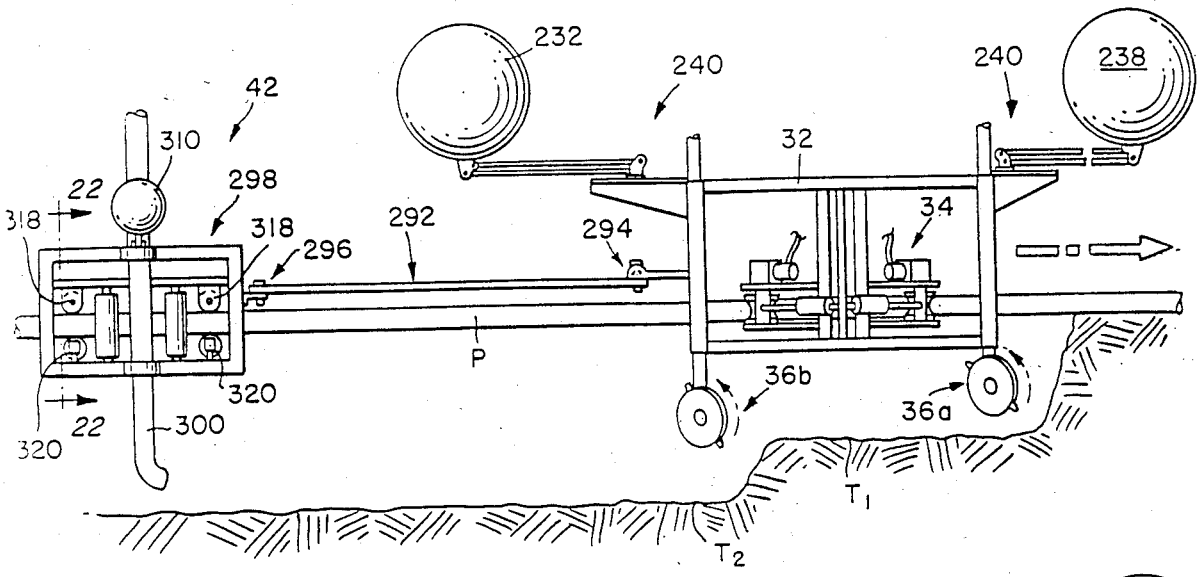
FIG. 20 is a side-elevational view of another embodiment of the present invention illustrating the use of an eductor carriage.
Figure 23:
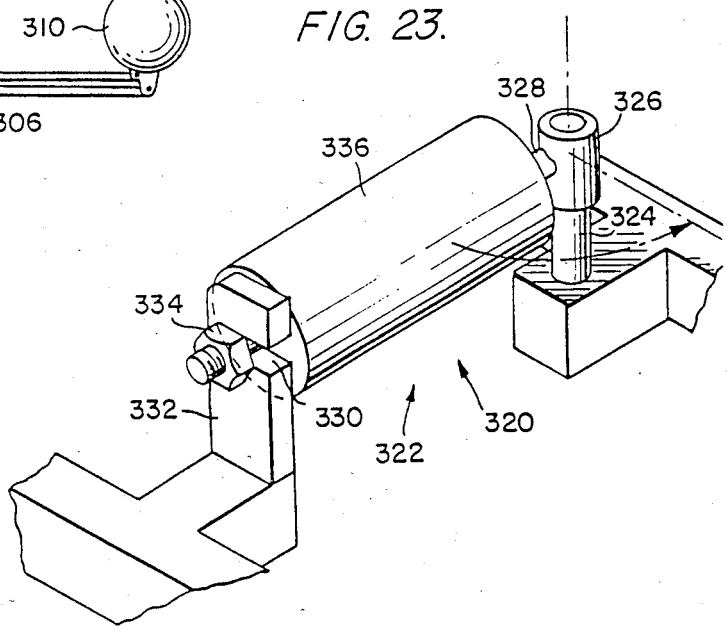
FIG. 23 is a perspective enlarged view of the mounting system of FIG. 22.

To more effectively and completely discharge the cuttings cut by cutting assembly 36 it has been found that eductor 40 should be positioned a distance, preferably 10 to 30 feet, behind the frame 32 so that the cuttings have more time to settle and therefore be more thoroughly discharged from the trench. Therefore, it is a further object of the present invention to provide an eductor carriage shown generally at 42 in FIGS. 20 through 22, which is towed behind frame 32 via tow bar 292. It is seen from FIG. 20 that tow bar 292 is connected via a suitable pivotal connection means 294 at its foreward end and to frame 32 and via suitable pivotal connection means 296 at its rear end to eductor carriage 42. Eductor carriage 42 includes a frame shown generally at 298 positionable about pipeline P, a pair of eductor tubes 300 and 302 secured to outer frame members 304 and 306, a pair of adjustable buoyancy tanks 308 and 310 and a guide roller assemby shown generally at 312 positioned within frame 298. Guide roller assembiy 312 includes two pairs of opposed vertically mounted guide rollers shown at 314 and 316 and a pair of upper guide rollers 318 and an opposed pair of lower guide rollers 320. As is seen in FIGS. 20 and 21 upper guide roller pair 318 and lower guide roller pair 320 are positioned outside of side rollers 314 and 316. Since buoyancy tanks 308 and 310 provide an upward buoyant force on frame 298 tending to lift it off pipe P, bottom guide rollers 320 are needed. However, when it is desired to lift eductor carriage 42 off pipe P, or lower it onto pipe P, the bottom guide rollers 320 must be positioned so that they do not interfere with this repositioning of the frame. Lower guide roller mounting means shown at 322 in FIG. 23 is therefore provided. As shown therein it includes a vertical bar 324 on which collar 326 is rotatably mounted. Shaft 328 is connected at one end to collar 326 and at the other end is positionable in slot 330 in upright member 332; it may be held therein by the tightening of nut 334. Guide roller 336 rotates about shaft 328, thereby providing the necessary bottom-of-the-pipe guiding function. Thus, the bottom guide roller 320 is shown in FIG. 23 to be in its operative position but may be readily swung to the side and out of the way of the pipe by merely loosening nut 334 and moving roller 336 about shaft 324 until it is out of the way of the pipe.

Figure 24:
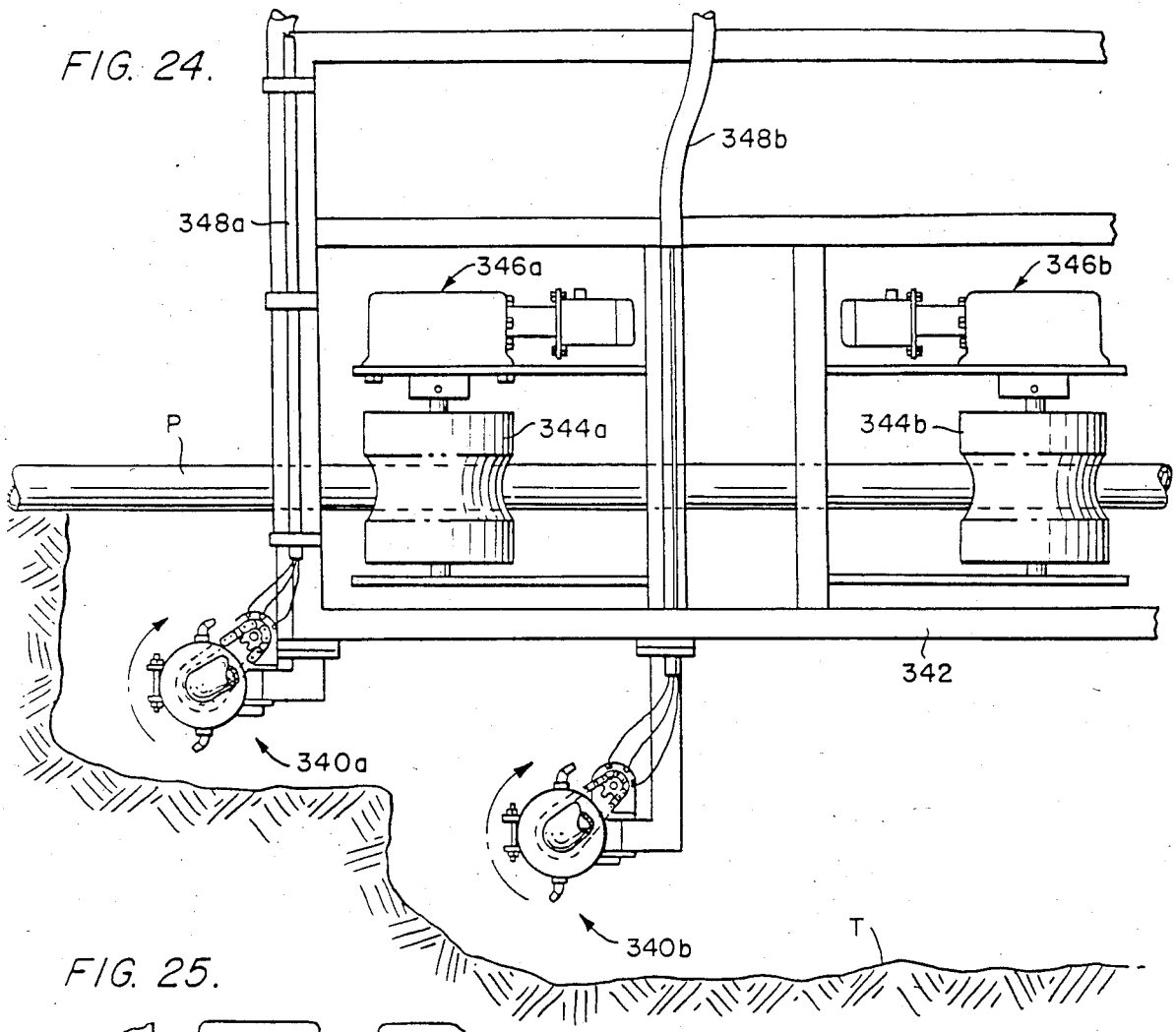
FIG. 24 is a partially broken away, side-elevational view similar to FIG. 2 illustrating another embodiment of the present invention including a novel rotating jet assembly.
Figure 25:
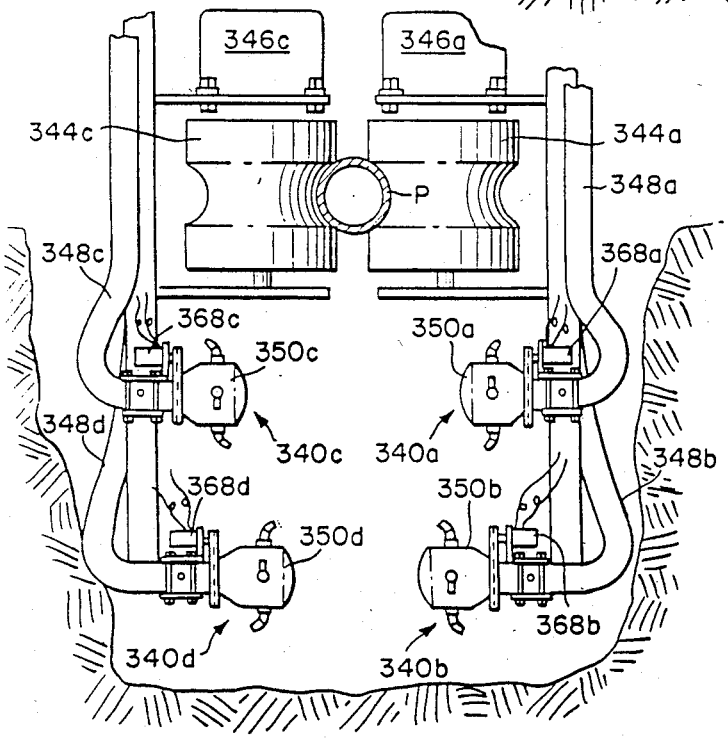
FIG. 25 is a front end view of the underwater trenching apparatus of FIG. 24.
Figure 26:
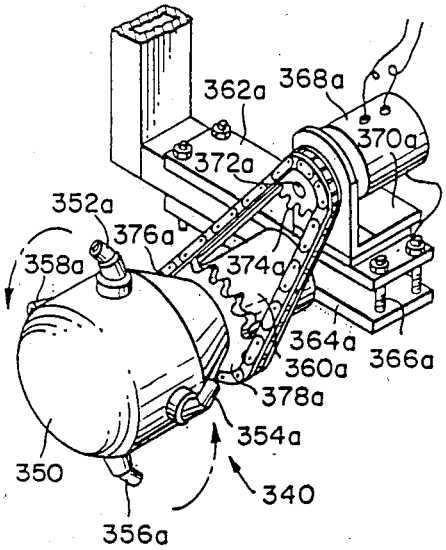
FIG. 26 is an enlarged perspective view of one of the rotating jet assembles of FIGS. 24 and 25.

A further design for each of the cutting assemblies shown generally at 340*a*, 340*b*, 340*c*, and 340*d* is illustrated in FIGS. 24–26. The underwater trenching apparatus, the forward portion of which is illustrated, comprises with the exception of the cutting assemblies, the same general structure as previously described for the other embodiments. This structure includes a frame 342 driven along pipeline P by rollers 344*a*, 344*b*, and 344*c* (a fourth roller is not shown). The rollers are pressed into driving contact with pipeline P by hydraulic rams and are each rotated by hydraulic motors and gearing 346*a*, 346*b*, and 346*c* respectively.

Details of cutter assembly 340*a* are best illustrated in FIG. 26. It is understood that each of the cutter assembles 340*a*, 340*b*, 340*c*, and 340*d* has a generally identical construction and like parts are identified in the drawings by like reference numbers followed by a, b, c, or d, respectively. Referring thereto it is seen that pressurized fluid pressure lines 348*a* feed to tank 350*a*. Tank 350*a* includes a plurality of openings symmetrically spaced about a vertical plane with nozzles 352*a*, 354*a*, 356*a*, and 358*a* extending therefrom. Each of the nozzles is shown to be directed at a slight angle from the vertical plane so that a wider path is cut as the tank is rotated about its horizontal axis.

Cutter assembly 340*a* is mounted to frame 342 by arm 360*a* projecting in a forward direction from the frame. Opposing plates 362*a* and 364*a* are positioned on either side of arm 360*a* and bolted together by bolts 366*a* thereby securing pressure line 348*a* positioned therebetween in place. Electric motor 368*a* is mounted to plate 362*a* by bracket 370*a* and is positioned so that its output shaft 372*a* is generally parallel to the axis of rotation of tank 350*a*. When shaft 372*a* is rotated, driving sprocket 374*a* mounted thereon is caused to rotate. Chain 376*a* is reeved about driving sprocket 374*a* at one end and about driven sprocket 378*a* at its other end. Driven sprocket 378*a* is mounted to tank 350*a* so that, when driving sprocket 374*a* is caused to rotate, this motion is transmitted to driven sprocket 378*a* and thus tank 350*a* causing them to rotate. As tank 350*a* rotates and water is forced out of the nozzles a blade of high pressure water thereby generated cuts a trench into which pipeline P falls.

It is also within the scope of the present invention to utilize part of the water pressure of the pressure lines to rotate the tank. To accomplish this suitable vanes (not shown) can be provided in the tank. These vanes are positioned about the axis of rotation and oriented so that as the water impacts them the tank is caused to rotate.

From the foregoing detailed description, it will be evident that there are a number of changes, adaptations and modifications of the present invention which come within the province of those persons having ordinary skill in the art. However, it is intended that all such variations not departing from the spirit of the invention be considered as within the scope thereof as limited solely by the appended claims.

We claim:

1. An underwater trenching apparatus for burying pipeline and the like comprising:

a frame for positioning about the pipeline to be buried, a driving means operatively connected to said frame for driving said frame along the pipeline, said driving means including at least one pair of opposed rollers adapted to drivingly engage the pipeline, said driving means further including an urging means for urging said curved pipe contact surface against the pipeline, each said roller having a curved pipe contact surface having a radius not greater than the radius of the pipeline to be buried, and when compressed against the pipeline by said urging means, being in continuous contact with it, and a cutting means attached to said frame for cutting a trench.

2. The apparatus of claim 1 including, each said curved pipe contact surface being convex and having a radius less than the outer radius of said pipeline.

3. The apparatus of claim 2 including, each said roller having a pipe contact surface configured to be placed in rolling traction contact by said urging means with between 30 percent and 50 percent of the circumference of the pipeline.

4. The apparatus of claim 3 including, each said roller having a pipe contact surface configured to be placed in rolling traction contact by said urging means with generally 40 percent of the circumference of the pipe.

5. An underwater trenching apparatus for burying pipeline and the like comprising:

a frame for positioning about the pipeline to be buried, a driving means operatively connected to said frame for driving said frame along said pipeline, said driving means including a roller adapted to drivingly engage the pipeline, said roller including a convex pipe contact surface having a radius less than the outer radius of the pipeline adapted to be in constant rolling contact relation with at least 60 percent of the circumference of the pipeline when driving said frame, said driving means further including an urging means for urging said convex pipe contact surface against the pipeline, a cutting means attached to said frame for cutting a trench, and a buoyancy means connected to said frame.

6. The apparatus of claim 5 including, said surface when compressed into said pipeline being in continuous contact with said pipeline.

7. An underwater trenching apparatus for burying pipeline and the like comprising:

a frame for positioning about the pipeline to be buried, a driving means operatively connected to said frame for driving said frame along the pipeline, a rotating cutting means rotating about a generally horizontally disposed axis generally transverse to the pipeline when said frame is positioned about the pipeline and supported by said frame for cutting a trench in the boftom of a body of water for burying the pipeline, and said rotating cutting means comprising a rotating fluid jet means and a rotating means for rotating said rotating fluid jet means about said generally horizontally disposed axis.

8. The apparatus of claim 7 including, an eductor means positioned behind said rotating cutting means for drawing up portions of cuttings cut by said rotating cutting means in the trench and discharging these portions away from the trench.

9. The apparatus of claim 7 including, said rotating fluid jet means including at least two diametrically opposed water outlets.

10. The apparatus of claim 9 including, each said water outlet having a generally one half-inch nozzle.

11. The apparatus of claim 9 including, said rotating fluid jet means further including said rotating means causing rotation about a generally vertical plane of rotation and said water outlets being offset from said plane of rotation.

12. The apparatus of claim 11 including, said water outlets being offset to opposite sides of said plane of rotation.

13. The apparatus of claim 11 including, said water outlets being offset from said plane of rotation between 5° and 20°.

14. The apparatus of claim 7 including, said rotating means including a hydraulic motor.

15. The apparatus of claim 9 including, said rotating means causing said water outlets to rotate between 1 and 10 revolutions per minute.

16. The apparatus of claim 9 including, said rotating means causing said water outlets to rotate between 20 and 30 revolutions per minute.

17. The apparatus of claim 7 including, said rotating fluid jet means exerting a water pressure of 650 to 675 psi.

18. The apparatus of claim 7 including, a sawing means connected to said frame, and said rotating means rotating said sawing means about said horizontal axis.

19. An underwater trenching apparatus for burying pipeline and the like comprising:

a frame for positioning about the pipeline to be buried, a driving means operatively connected to said frame for driving said frame along the pipeline, a scooping means attached to said frame and rotating about a generally horizontal axis when said frame is positioned about the pipeline for scooping out a formation to form a trench in the direction said driving means is driving said frame, by scooping the ocean floor material generally up and forward relative to said frame, and a dispersing means operatively associated with said scooping means for dispersing the scooped material up and away from said trench formed at least in part by said scooping means.

20. The apparatus of claim 19, including, an eductor means positioned behind said scooping means for drawing up portions of scooped material in the trench and discharging these portions away from the trench.

21. The apparatus of claim 19 including, said scooping means and said dispersing means comprising a rotating fluid jet means.

22. The apparatus of claim 21 including, said rotating fluid jet means including at least two water outlets and a rotating means for rotating said water outlets about a generally horizontal axis.

23. The apparatus of claim 22 including, each said water outlet alternately cutting and dispersing.

24. The apparatus of claim 22 including, said at least two water outlets comprising two diametrically opposed water nozzles.

25. The apparatus of claim 22 including, said rotating fluid jet means further including said rotating means causing rotation about a generally vertical plane of rotation perpendicular to said generally horizontal axis and said water outlets being offset from said plane of rotation.

26. The apparatus of claim 25 including, said water outlets being offset from said plane of rotation between 5° and 20°.

27. The apparatus of claim 22 including, said rotating means including a hydraulic motor.

28. The apparatus of claim 22 including, said rotating means causing said water outlets to rotate between 1 and 10 revolutions per minute.

29. The apparatus of claim 22 including, said rotating means causing said water outlets to rotate between 20 and 30 revolutions per minute.

30. The apparatus of claim 21 including, said rotating fluid jet means exerting a water pressure of 650 to 675 psi.

31. The apparatus of claim 25 including, a reorienting means for reorienting said vertical plane of rotation.

32. The apparatus of claim 31 including, a moving means for moving said rotating fluid jet means vertically.

33. The apparatus of claim 32 including, said reorienting means being associated with said moving means.

34. The apparatus of claim 21 including, a moving means for moving said rotating fluid jet means vertically.

35. The apparatus of claim 21 including, said scooping means comprising three pairs of rotating fluid jet means spaced longitudinally along said frame.

36. The apparatus of claim 21 including, said rotating fluid jet means including at least one pair of opposed jets, and a mounting means for mounting said pair of opposed jets to said frame on opposite sides of the pipeline and being adapted to swing open to admit the pipeline.

37. The apparatus of claim 22 including, a sawing means connected to said frame.

38. The apparatus of claim 37 including, said rotating means rotating said sawing means.

39. An underwater trenching apparatus for burying pipeline and the like comprising:

a frame for positioning about the pipeline to be buried, a driving means operatively connected to said frame for driving said frame along said pipeline, a buoyancy means connected to said frame, a cutting means for forming a trench in a formation by scooping up the formation, said cutting means comprising a plurality of rotating water jet nozzles and a rotating means operatively connected to said rotating water jet nozzles for rotating them so that they each generate an upright curved path of water originating from the bottom of the formation to be cut and progressing upwardly toward the vertical.

40. The apparatus of claim 39 including, an eductor means for drawing up portions of cuttings cut by said cutting means and discharging these portions away from the trench.

41. An underwater trenching apparatus for burying pipeline and the like comprising:

a frame for positioning about the pipeline to be buried, a driving means operatively connected to said frame for driving said frame along the pipeline, and a cutting means attached to said frame for cutting a trench, said cutting means including two spaced fluid jet means, each said fluid jet means having a generally vertically disposed jet tube, a rotating means for simultaneously rotating said jet tubes in opposite directions, and a longitudinal movement means for raising and lowering both said jet tubes together, relative to said frame said longitudinal movement means being independent of said rotating means.

42. The apparatus of claim 41 including, a support means for supporting said jet tubes in a generally vertical position.

43. The apparatus of claim 42 including, said support means including a pair of vertically disposed sleeves mounted to said frame.

44. The apparatus of claim 41 including, said longitudinal movement means including a grease jack means.

45. The apparatus of claim 41 including, said longitudinal movement means including a vertically disposed grease jack secured at one end to said frame and at the other end to a member extending between said jet tubes, a first attaching means for attaching one end of said member to one said jet tube, said first attaching means allowing said one said jet tube to rotate freely and engage said one said jet tube in a manner whereby as said grease jack means is extended and retracted said one said jet tube is raised and lowered, and a second attaching means for attaching an opposite end of said member to the other said jet tube, said second attaching means allowing said other said jet tube to rotate freely and engage said other said jet tube in a manner whereby as said grease jack is extended and retracted said other said jet tube is raised and lowered.

46. The apparatus of claim 45 including, said first connecting means including a first pad eye attached to said one said jet tube and a first pivotal connection means at the outer end of said first rod for pivotally connecting said outer end to said pad eye, and said second connecting means including a second pad eye attached to said other said jet tube and a second pivotal connection means at the outer end of said second rod for pivotally connecting said outer end to said second pad eye.

47. The apparatus of claim 42 including, said rotating means including a generally horizontally disposed hydraulic ram having first and second rods extending from opposite ends, a first connecting means for connecting said first rod to one said jet tube, and a second connecting means for connecting said second rod to the other said jet tube.

48. An underwater trenching apparatus for burying pipeline and the like comprising:

a frame for positioning about the pipeline to be buried, a driving means operatively connected to said frame for driving said frame along said pipeline in forward and aft directions when positioned about the pipeline, a buoyancy means connected to said frame, a cutting means for forming a trench in a formation by scooping up the formation, said cutting means including forward and aft cutting means spaced longitudinally on said frame forward and aft of said driving means, the upper portion of said forward and aft cutting means being positionable in the horizontal plane of the lower surface of the pipeline, said frame having a first bottom surface positioned above said forward cutting means, a second bottom surface positioned beneath said driving means, and a third bottom sufface positoned above said aft cutting means, said first bottom surface and said third bottom surface being positioned above said second bottom surface, and a positioning means for positioning said forward cutting means generally higher than said aft cutting means when said driving means is driving said frame in said forward direction and said aft cutting means generally higher than said forward cutting means when said driving means is driving said frame in said aft direction.

49. The apparatus of claim 48 including, an eductor means for drawing up portions of cuttings cut by said cutting means and discharging these portions away from the trench.

50. The apparatus of claim 48 including, a third cutting means positioned beneath said second bottom surface.

51. The apparatus of claim 48 including, a forward buoyancy means attached to said frame generally forward of said forward pair of cutting means to said frame, and an aft buoyancy means attached to said frame generally aft of said aft pair of cutting means.

52. The apparatus of claim 48 including, said frame including opposing lower side members positioned outside of said forward and aft pairs of cutting means.

53. An underwater trenching apparatus for burying pipeline and the like comprising:

a frame for positioning about the pipeline to be buried, a driving means operatively connected to said frame for driving said frame along said pipeline, a cutting means attached to said frame for cutting a trench, a buoyancy means connected to said frame and positioned on opposite sides of said pipeline, and a positioning means secured to said buoyancy means for locating said buoyancy means relative to said frame for selectively varying the torque produced by said buoyancy means to compensate for variable rotational torques exerted on said frame by underwater currents.

54. The apparatus of claim 53 including, an eductor means for drawing up portions of cuttings cut by said cutting means and discharging these portions from the trench.

55. The apparatus of claim 54 including, said adjustable compensating means including two sets of buoyancy tanks adjustably connected to said frame on opposite sides of the pipeline.

56. The apparatus of claim 55 including, each said set of buoyancy tanks being movable between a first position generally adjacent said pipeline and a second position horizontally spaced from said first position away from said pipeline.

57. The apparatus of claim 56 including for each said buoyancy tank of each said set of buoyancy tanks, an arm, a frame connecting means for connecting one end of said arm to said arm to said frame, and a buoyancy tank connecting means for connecting the opposite end of said arm to one said buoyancy tank.

58. The apparatus of claim 57 including, said frame connecting means allowing said arm to pivot about a vertical axis.

59. The apparatus of claim 58 including, said frame connecting means allowing said arm to pivot about a horizontal axis adjacent said one end of said arm.

60. The apparatus of claim 59 including, a means associated with said frame connecting means and said buoyancy tank connecting means for maintaining said buoyancy tank in a constant upright position as said arm pivots about said horizontal axis.

61. The apparatus of claim 57 including, an adjustable anchor means means for anchoring said arm to said frame at the desired angle relative to said frame.

62. An underwater trenching apparatus for burying pipeline and the like comprising:

a frame for positioning about the pipeline to be buried, a driving means operatively connected to said frame for driving said frame along said pipeline, a cutting means attached to said frame for cutting a trench, a buoyancy means connected to said frame and including at least one buoyancy tank and an exerting means independent of the buoyancy effect of said buoyancy tank for exerting a variable torque on said frame to compensate for the torque exerted on said apparatus by variable underwater currents.

63. The apparatus of claim 62 including, an eductor means for drawing up portions of cuttings cut by said cutting means and discharging these portions from the trench.

64. An underwater trenching apparatus for burying pipeline and the like comprising:

a frame for positioning about the pipeline to be buried, a driving means operatively connected to said frame for driving said frame along the pipeline, a cutting means attached to said frame for cutting a trench, at least one buoyancy tank connected to said frame, each said bouyancy tank having a water inlet and outlet means positioned generally on a bottom surface thereof, an air inlet means positioned generally on a bottom surface thereof, and a plurality of air outlet means communicating with the surrounding water and the interior of said cuoyancy tank and positioned above said air inlet means, each said air outlet means being positioned on a different horizontal plane, and each said air outlet means being selectively opened or closed to vary the level of air in said buoyancy tank and thus its buoyancy effect on said frame.

65. The apparatus of claim 64 including, the uppermost of said air outlet means being positioned on the upper surface of said tank.

66. The apparatus of claim 64 including, an eductor means for drawing up portions of cuttings cut by said cutting means in the trench and discharging these portions away from the trench.

67. An underwater trenching apparatus for burying pipeline and the like comprising:

a frame for positioning about the pipeline to be buried, a driving means operatively connected to said frame for driving said frame along the pipeline, a cutting means attached to said frame for cutting a trench, a carriage positionable about the pipeline, a spacing means for keeping said carriage in spaced relation behind said frame as said driving means drives said frame along said pipeline, and an eductor means supported by said carriage, said eductor means including an eductor means inlet spaced from said cutting means at least in part by said spacing means for drawing up portions of cuttings cut by said cutting means in the trench and an eductor means outlet for discharging these portions away from the trench.

68. The apparatus of claim 67 including, said spacing means keeping said cutting means and said eductor means spaced generally between 10 and 50 feet.

69. The apparatus of claim 67 inc1uding, a carriage driving means for driving said carriage along said pipeline.

70. The apparatus of claim 69 including, said driving means including said carriage driving means.

71. The apparatus of claim 67 including, said spacing means including a rigid tow bar pivotally connected at its forward end to said frame and at its rearward end to said carriage.

72. The apparatus of claim 67 including, a guide roller means attached to said carriage and positioned adjacent said pipeline.

73. The apparatus of claim 72 including, said guide roller means including a bottom guide roller means positioned beneath said pipeline and a guide roller connecting means for connecting said bottom guide roller means to said carriage.

74. The apparatus of claim 73 including, said connecting means allowing said bottom guide roller means to be pivoted to a position so that said carriage can be lifted up and off the pipeline.

75. The apparatus of claim 72 including, a buoyancy means connected to said carriage.

76. An underwater trenching apparatus for burying pipeline and the like comprising:

a frame for positioning about the pipeline to be buried, a driving means operatively connected to said frame for driving said frame along the pipeline, a cutting means attached to said frame for cutting a trench, said cutting means including two spaced fluid jet means, and a grease ram moving means for moving said jet means generally and primarily vertically relative to said frame.

77. An underwater trenching apparatus for burying pipeline and the like comprising:

a frame for positioning about the pipeline to be buried, a driving means operatively connected to said frame for driving said frame along the pipeline, a rotating fluid jet means for cutting a trench in the bottom of a body of water for burying the pipeline, and a rotating means for rotating said fluid jet means about a horizontal axis disposed generally perpendicular to and beneath the pipeline when said frame is positioned about the pipeline to assist said rotating fluid jet means in cutting the trench.

78. The apparatus of claim 77 including, said rotating means including a rotating shaft positioned parallel to and spaced from said horizontal axis, and a connecting means for drivingly connecting the output of said rotating shaft to said fluid jet means for rotating said fluid jet means.

79. The apparatus of claim 78 including, said connecting means comprising a first sprocket mounted to said rotating shaft, a second sprocket mounted to said fluid jet means and having an axis of rotation coincident with said horizontal axis, and a chain means reeved about said first and second sprockets whereby when said rotating shaft rotates said first sprocket causes said second sprocket to rotate said fluid jet means.

80. The apparatus of claim 77 including, said fluid jet means including a tank having a plurality of outlets disposed generally in the same vertical plane and symmetrical relative to said horizontal axis, a plurality of nozzles, each said nozzle extending from one said outlet, at least two said nozzles directing fluid out of said tank in a direction offset from said vertical plane.

81. The apparatus of claim 77 including, said fluid jet means including a directing means for directing fluid against the bottom of said body of water of said body of water to form a trench and a supplying means for supplying pressurized fluid to said directing means, and said rotating means comprising a vane means positioned so that pressurized fluid from said supplying means prior to reaching said directing means impacts said vane means causing said fluid jet means to rotate about said horizontal axis.

82. The apparatus of claim 1 including, each said roller being formed of a hard deformable material.

83. The apparatus of claim 5 including, said roller being formed of a hard deformable material.

84. The apparatus of claim 76 including, said grease ram moving means including a grease ram having at least two fittings adapted to be operatively connected to a grease gun.

85. The apparatus of claim 19 including, a moving means for moving said scooping means vertically to reposition said generally horizontal axis.

86. The apparatus of claim 67 including, said driving means being attached to and supported by said frame, said carriage being attached to said frame, and said spacing means spacing said eductor means from said cutting means.

87. An underwater trenching apparatus for burying pipeline and the like comprising:

a frame for positioning about the pipeline to be buried, a cutting means attached to said frame for cutting a trench, a driving means operatively connected to said frame for driving said frame along said pipeline, said driving means including first and second pairs of drive roller assemblies, said first and second pairs being disposed on opposite sides of the pipeline, each said pair of drive roller assemblies including a first arm, a first arm connecting means for pivotally connecting one end of said first arm to said frame, a first drive roller attached to the other end of said first arm and positionable to engage the pipeline, a first roller rotating means operatively connected to said first drive roller for rotating said first drive roller, a first urging means for urging said first drive roller against the pipeline having one end connected to said first arm and an opposite end operatively connected to said frame by a first urging means connecting means positioned further from the pipeline than said first arm connecting means, said cutting means including a generally vertically disposed jet tube, a support plate attached to said jet tube and extending away from the pipeline, and said first urging means connecting means being attached to said support plate.

88. An underwater trenching apparatus for burying pipeline and the like comprising:

a frame for positioning about the pipeline to be buried, a cutting means attached to said frame for cutting a trench, a driving means operatively connected to said frame for driving said frame along said pipeline, said driving means including first and second pairs of drive roller assemblies, said first and second pairs being positionable on opposite sides of the pipeline, each said pair of drive roller assemblies including a first arm, a first arm connecting means for pivotally connecting one end of said first arm to said frame, a first drive roller attached to the other end of said first arm and positionable to engage the pipeline, a first roller rotating means operatively connected to said first drive roller for rotating said first drive roller, a first urging means for urging said first drive roller against the pipeline and having one end connected to said first arm and an opposite end, and a first urging means connecting means operatively connecting said opposite end to said frame, each said pair of drive roller assemblies further including a second arm, a second arm connecting means for pivotally connecting one end of said second arm to said frame, a second drive roller attached to the other end of said second arm and positionable to engage the pipeline, a second roller rotating means operatively connected to said second drive roller for rotating said second drive roller, a second urging means for urging said second drive roller against the pipeline and having one end connected to said second arm and an opposite end, and a second urging means connecting means operatively connecting said opposite end to said frame, and said first and second urging means connecting means being disposed between said first and second drive rollers.

89. The apparatus of claim 88 including, said first urging means connecting means being positioned further from the pipeline and from said first drive roller than is said first arm connecting means.

90. The apparatus of claim 88 including, a support member attached to said frame, and said first and second urging means connecting means being attached to said support member.

91. The apparatus of claim 90 including, said support member extending out from said frame.

92. The apparatus of claim 88 including, said first and second urging means comprising hydraulic ram means.

93. The apparatus of claim 88 including, an eductor means positioned generally behind said cutting means for drawing up from the trench portions of the cuttings cut by said cutting means and discharging these portions away from the trench.

94. The apparatus of claim 88 including, said first arm connecting means comprising a removable pivotal connecting means, and said removable pivotal connecting means including a shaft mounted to said first arm, a bearing means mounted to said frame, said shaft being rotatably disposed in said bearing means, and a disengagable preventing means for preventing said shaft from moving axially out of said bearing means.

95. The apparatus of claim 94 including, said disengageable preventing means including a pin means attachable to said shaft.

96. The apparatus of claim 88 including, said first arm connecting means comprising a removable pivotal connecting means, and said removable pivotal connecting means including a shaft secured to said frame, a bearing means positioned between said first arm and said shaft for freely rotating said first arm about said shaft, and a disengageable preventing means for preventing said shaft from moving axially out of said frame.

97. The apparatus of claim 96 including, said disengagable preventing means including a pin means attachable to said shaft.

98. An underwater trenching apparatus for burying pipeline and the like comprising:

a frame for positioning about the pipeline to be buried, a driving means operatively connected to said frame for driving said frame along the pipeline, and a rotating cutting means rotating about a generally horizontally disposed axis when said frame is positioned about the pipeline and supported by said frame for cutting a trench in the bottom of a body of water for burying the pipeline, said rotating cutting means comprising a rotating fluid jet means and a rotating means for rotating said rotating fluid jet means about said generally horizontally disposed axis, a sawing means connected to said frame, and said rotating means rotating said sawing means together with said fluid jet means about said generally horizontally disposed axis.

* * * * *